US012637843B2

(12) United States Patent
Olsen et al.

(10) Patent No.: US 12,637,843 B2
(45) Date of Patent: May 26, 2026

(54) SYSTEM FOR TUNING HYDRAULIC COMPONENTS OF A PRODUCTION DIGGER

(71) Applicant: ORANGE MINING RESEARCH PTY LTD, Kensington (AU)

(72) Inventors: Peder Olsen, Kensington (AU); Rovik Olsen, Bull Creek (AU)

(73) Assignee: ORANGE MINING RESEARCH PTY LTD, Kensington (AU)

( * ) Notice: Subject to any disclaimer, the term of this patent is extended or adjusted under 35 U.S.C. 154(b) by 0 days.

(21) Appl. No.: 18/263,062

(22) PCT Filed: May 13, 2022

(86) PCT No.: PCT/AU2022/050454
§ 371 (c)(1),
(2) Date: Jul. 26, 2023

(87) PCT Pub. No.: WO2022/236376
PCT Pub. Date: Nov. 17, 2022

(65) Prior Publication Data

US 2024/0076856 A1 Mar. 7, 2024

(30) Foreign Application Priority Data

May 13, 2021 (AU) ..... 2021901422

(51) Int. Cl.
*E02F 3/00* (2006.01)
*E02F 3/43* (2006.01)
*E02F 9/26* (2006.01)

(52) U.S. Cl.
CPC ..... *E02F 9/265* (2013.01); *E02F 3/435* (2013.01)

(58) Field of Classification Search
None
See application file for complete search history.

(56) References Cited

U.S. PATENT DOCUMENTS

| | | | | |
|---|---|---|---|---|
| 10,521,703 | B2 | 12/2019 | Beschorner et al. | |
| 2016/0273186 | A1* | 9/2016 | Kami | E02F 9/2296 |
| 2020/0081030 | A1 | 3/2020 | Currier | |
| 2020/0181884 | A1* | 6/2020 | Green | G01C 19/00 |
| 2020/0378794 | A1 | 12/2020 | Yoda et al. | |

(Continued)

FOREIGN PATENT DOCUMENTS

| | | | |
|---|---|---|---|
| WO | 2010121713 | A1 | 10/2010 |
| WO | 2016043270 | A1 | 3/2016 |

OTHER PUBLICATIONS

Extended European Search Report for related European Patent Application No. 22806129.7, dated Jan. 29, 2025, 9 pages.

(Continued)

*Primary Examiner* — James M McPherson
(74) *Attorney, Agent, or Firm* — HAYNES AND BOONE, LLP

(57) ABSTRACT

Disclosed herein is a system for tuning hydraulic components of a production digger. The system may comprise a sensor units mounted to the body, boom, stick and bucket of the production digger, and a processor in communication with the sensor units configured to receive signals and determine the rotational velocity and acceleration of various components of the digger around joints of the digger, and display tuning information to a user.

17 Claims, 20 Drawing Sheets

(56) References Cited

U.S. PATENT DOCUMENTS

| | | | | |
|---|---|---|---|---|
| 2021/0032849 | A1* | 2/2021 | Struss | E02F 9/2004 |
| 2021/0087794 | A1* | 3/2021 | Yamamoto | B60R 1/27 |
| 2022/0057206 | A1* | 2/2022 | Richardson | E02F 9/26 |
| 2022/0220694 | A1* | 7/2022 | Suzuki | E02F 3/437 |
| 2024/0102266 | A1* | 3/2024 | Ishihara | E02F 9/265 |

OTHER PUBLICATIONS

International Search Report and Written Opinion for International Application No. PCT/AU2022/050454, issued by the International Searching Authority, dated Jun. 3, 2022; 11 pages.

Ren, Z. et al., 'Active-Side Calculation Method for a Backhoe Hydraulic Excavator with Incomplete Digging Resistance in a Normal State', Mathematical Problems in Engineering. 2019, vol. 2019; 13 pages.

Mitrev, R. et al., 'Numerical study of the hydraulic excavator overturning stability during performing lifting operations', Advances in Mechanical Engineering. 2019, vol. 11; 14 pages.

* cited by examiner

SYSTEM FOR TUNING HYDRAULIC COMPONENTS OF A PRODUCTION DIGGER

CROSS REFERENCE

This application is a United States national phase application of International Patent Application Number PCT/AU2022/050454, filed May 13, 2022, which claims priority to Australian Patent Application Number 2021901422, filed May 13, 2021, the entire disclosures of which are hereby incorporated herein by reference.

TECHNICAL FIELD

The present disclosure relates to a system for tuning the hydraulic components of a production digger. In particular, the present disclosure relates to a system that is configured to assess the kinematic performance of hydraulic components of a production digger to enable rectification of problems and thereby more optimal performance of the production digger.

BACKGROUND ART

Production diggers, which include for example hydraulic excavators, hydraulic mining shovels and backhoes, include several components that rotate with respect to one another. These components include the cab, boom, stick and bucket. The components are rotatably connected to one another at joints. Rotational movement is produced by hydraulic actuators that are connected between the components of the production digger.

Hydraulic components of production diggers are typically configured through a process known as 'hydraulic pump tuning'. Hydraulic pump tuning currently defines the performance of the hydraulic components of the production digger (e.g. the rotational velocity of components of the production digger). Hydraulic pump tuning takes place at initial commissioning of a new production digger, as well as during subsequent servicing, most often following major component change outs (i.e., hoses, hydraulic system components and main hydraulic pumps). The optimal operation of the hydraulic components of a production digger, and thus the production digger as a whole, is typically specified by the manufacturer of the production digger. During hydraulic system tuning, hydraulic pumps associated with each of the hydraulic actuators are set-up with a specified pressure and flow.

In addition to confirming that the pressure and flow for hydraulic components is as specified by the manufacturer, performance assessment of production diggers typically occurs by timing the speed in which a component is able to complete a 'characteristic movement' (i.e., the body (slew, yaw), boom (up and down), stick (in and out), bucket (curl and dump, in and out). These measured times for each characteristic movement are then compared to times specified by the production digger manufacturer to qualify production digger performance.

There are several technical problems associated with the current hydraulic component configuration and production digger performance assessment procedures. For example, hydraulic tuning to specified parameters does not guarantee that a production digger will perform as specified by a manufacturer. Tuning hydraulic components to specified parameters can result in sub-optimal performance of the production digger, for several reasons (e.g. faulty cylinders (actuators), poor engine output, a faulty control system (levers and actuators), excessive mechanical friction due to worn pins and Bearings (slew ring), etc.). Also, in the event that the time measured during commissioning is greater than the time specified by a manufacturer for characteristic movements, the typical solution is to ensure that the hydraulic tuning is as specified. In the event that the hydraulic tuning is as specified, this may result in the production digger operator being blamed for sub-optimal performance. Therefore, current production digger performance assessment procedures are also subject to human error (e.g. operator error, an error in the assessment of an operator, incorrect hydraulic tuning, timing error, etc.).

In this specification, unless the contrary is expressly stated, where a document, act or item of knowledge is referred to or discussed, this reference or discussion is not an admission that the document, act or item of knowledge or any combination thereof was at the priority date, publicly available, known to the public, part of common general knowledge; or known to be relevant to an attempt to solve any problem with which this specification is concerned.

SUMMARY

Disclosed herein is a system for tuning hydraulic components of a production digger, the production digger comprising an undercarriage configured to move the production digger, a body rotatably connected to the undercarriage about a first joint, a boom rotatably connected to the body about a second joint, a stick rotatably connected to the boom about a third joint, a bucket rotatably connected to the stick about a fourth joint, a first hydraulic component connected to the undercarriage and body that is configured to enable the body to rotate relative to the undercarriage, a second hydraulic component connected to the boom and the body that is configured to enable the boom to rotate relative to the body, a third hydraulic component connected to the boom and the stick that is configured to enable the stick to rotate relative to the boom, a fourth hydraulic component connected to the bucket and the stick that is configured to enable the bucket to rotate relative to the stick. The system may comprise a first sensor unit mounted to the body of the production digger, the first sensor unit being configured to output a plurality of first signals indicative of a rotational velocity of the body about the first joint and a rotational acceleration of the body about the first joint; a second sensor unit mounted to the boom of the production digger, the second sensor unit being configured to output a plurality of second signals indicative of a rotational velocity of the boom about the second joint and a rotational acceleration of the boom about the second joint; a third sensor unit mounted to the stick of the production digger, the third sensor unit being configured to output a plurality of third signals indicative of a rotational velocity of the stick about the third joint and a rotational acceleration of the stick about the third joint; a fourth sensor unit mounted to the bucket of the production digger, the fourth sensor unit being configured to output a plurality of fourth signals indicative of a rotational velocity of the bucket about the fourth joint and a rotational acceleration of the bucket about the fourth joint; a processor in communication with the first, second, third and fourth sensor units, the processor being configured to: receive the plurality of first, second, third and fourth signals; determine the rotational velocity of the body about the first joint, and rotational acceleration of the body about the first joint in dependence on the plurality of first signals; determine the rotational velocity of the boom about the second joint, and the rotational acceleration of the boom about the second joint in dependence on the plurality second signals; determine the rotational velocity of the stick about the third joint, and the rotational acceleration of the stick about the third joint in dependence on the plurality third signals; determine the rotational velocity of the bucket about the fourth joint, and the rotational acceleration of the bucket about the fourth joint in dependence on the plurality fourth signals; a display in communication with the processor, the display being configured to: display tuning information to a user, the tuning information comprising the rotational velocity and rotational acceleration of the boom, stick, body and bucket determined by the processor, wherein the user is able to tune the first, second, third and fourth hydraulic components of the production digger in dependence on the tuning information.

Unlike existing performance assessment methods for production diggers, which may be able determine that a problem is present, but not the underlying performance metric which may produce the problem, the system disclosed herein is able to provide a holistic kinematic performance assessment of a production digger (and/or components thereof), which is a more reliable indicator of production digger performance. The system disclosed herein is able to display the assessed performance metrics to enable rectification (e.g. tuning of the hydraulic components) of the production digger to increase the performance of the production digger (e.g. speed, and therefore the amount of material that the production digger is able to move). In contrast to existing performance measurement techniques, the system disclosed herein provides a tool that may be used whilst digging, as the sensor units can be located away from the harsh digging environment. This may avoid unnecessary disruptions or the need to delay assessment until such time as routine machine servicing occurs. Advantageously, the automated system disclosed herein may also avoid inherent human error associated with existing performance assessment techniques (i.e., through use of a stop watch to time, or via hydraulic pump tuning), and provides information on non-linear metrics (i.e., velocity and acceleration) not provided by those techniques.

In some forms, the plurality of first signals is indicative of a relative position of the body, the plurality of second signals is indicative of a relative position of the boom, the plurality of third signals is indicative of a relative position of the stick, and the plurality of fourth signals is indicative of a relative position of the bucket.

In some forms, the processor is configured to determine the relative position of the body in dependence on the plurality of first signals, determine the relative position of the boom in dependence on the plurality of second signals, determine the relative position of the stick in dependence on the plurality of third signals, and determine the relative position of the bucket in dependence on the plurality of fourth signals, and the tuning information comprises the relative position of the body, bucket, stick and bucket determined by the processor.

In some forms, the first sensor unit comprises a first gyroscope that is arranged to measure the angular velocity of the body about a first axis of the first joint, and wherein the plurality first signals is indicative of the angular velocity of the body about the first axis.

In some forms, the first sensor unit comprises a magnetometer, an accelerometer and/or a GPS. The GPS may be dual antenna and include real time kinetic positioning functionality to enhance the precision of the system.

In some forms, the first sensor unit is arranged to measure the angular acceleration of the body about the first axis, and wherein the plurality of first signals comprises the angular acceleration of the body about the first axis.

In some forms, the first sensor unit is configured to output the plurality of first signals at between 1 Hz and 1 kHz (e.g. 200 Hz), and wherein each of the plurality of first signals comprises a timestamp.

In some forms, the processor is configured to determine first and second Euler angles of the first sensor, and wherein the plurality of first signals comprises the determined first and second Euler angles.

In some forms, the second sensor unit comprises a second gyroscope that is arranged to measure the angular velocity of the boom about a second axis, and wherein the plurality of second signals is indicative of the angular velocity of the boom about second axis.

In some forms, the second sensor unit comprises a magnetometer, an accelerometer and/or a GPS. The GPS may be dual antenna and include real time kinetic positioning functionality to enhance the precision of the system.

In some forms, the second sensor unit is arranged to measure the angular acceleration of the boom about the second axis, and wherein the plurality of second signal comprises the angular acceleration of the boom about the second axis.

In some forms, the second sensor unit is configured to output the plurality of second signals at between 1 Hz and 1 kHz (e.g. 200 Hz), and wherein each of the plurality of second signal comprises a timestamp.

In some forms, the processor is configured to determine third and fourth Euler angles of the second sensor, and wherein the plurality of second signal comprises the determined third and fourth Euler angles.

In some forms, the third sensor unit comprises a third gyroscope that is arranged to measure the angular velocity of the stick about a third axis, and wherein the plurality of third signals is indicative of the angular velocity of the stick about the third axis.

In some forms, the third sensor unit comprises a magnetometer, an accelerometer and/or a GPS. The GPS may be dual antenna and include real time kinetic positioning functionality to enhance the precision of the system.

In some forms, the third sensor unit is arranged to measure the angular acceleration of the stick about the third axis, and wherein the plurality of third signal comprises the angular acceleration of the stick about the third axis.

In some forms, the third sensor unit is configured to output the plurality of third signals at between 1 Hz and 1 kHz (e.g. 200 Hz), and wherein of the plurality of third signals comprises a timestamp.

In some forms, the processor is configured to determine fifth and sixth Euler angles of the third sensor, and wherein the plurality of third signals comprises the determined fifth and sixth Euler angles.

In some forms, the fourth sensor unit comprises a fourth gyroscope that is arranged to measure the angular velocity of the bucket about a fourth axis, and wherein the plurality of fourth signals is indicative of the angular velocity of the bucket about the fourth axis.

In some forms, the fourth sensor unit comprises a magnetometer, an accelerometer and/or a GPS. The GPS may be dual antenna and include real time kinetic positioning functionality to enhance the precision of the system.

In some forms, the fourth sensor unit is arranged to measure the angular acceleration of the stick about the fourth axis, and wherein the plurality of fourth signals comprises the angular acceleration of the stick about the fourth axis.

In some forms, the fourth sensor unit is configured to output the plurality of fourth signals at between 1 Hz and 1 kHz (e.g. 200 Hz), and wherein each of the plurality of fourth signals comprises a timestamp.

In some forms, the processor is configured to determine seventh and eighth Euler angles of the fourth sensor, and wherein the plurality of fourth signals comprises the determined seventh and eighth Euler angles.

In some forms, the processor is configured to compile the plurality of first signals to produce a first graph that plots the plurality of first signals against time.

In some forms, the processor is configured to determine a first region of interest in the first graph that represents a rotational movement of the body, and to determine the rotational velocity and rotational acceleration of the body in the first region of interest.

In some forms, the display is configured to display the rotational velocity and rotational acceleration of the body in the first region of interest.

In some forms, the processor is configured to compile the plurality of second signals to produce a second graph that plots the plurality of second signals against time.

In some forms, the processor is configured to determine a second region of interest in the second graph that represents a rotational movement of the boom, and to determine the rotational velocity and rotational acceleration of the boom in the second region of interest.

In some forms, the display is configured to display the rotational velocity and rotational acceleration of the boom in the second region of interest.

In some forms, the processor is configured to compile the plurality of third signals to produce a third graph that plots the plurality of third signals against time.

In some forms, the processor is configured to determine a third region of interest in the third graph that represents a rotational movement of the stick, and to determine the rotational velocity and rotational acceleration of the stick in the third region of interest.

In some forms, the display is configured to display the rotational velocity and rotational acceleration of the stick in the third region of interest.

In some forms, the processor is configured to compile the plurality of fourth signals to produce a fourth graph that plots the plurality of fourth signals against time.

In some forms, the processor is configured to determine a fourth region of interest in the fourth graph that represents a rotational movement of the bucket, and to determine the rotational velocity and rotational acceleration of the bucket in the fourth region of interest.

In some forms, the display is configured to display the rotational velocity and rotational acceleration of the bucket in the fourth region of interest.

In some forms, the first axis is a first axis of rotation of the first sensor unit, and wherein the processor is configured to determine whether the first sensor unit is mounted to the body such that an orientation of the first sensor unit is aligned with the first axis of rotation of the first sensor unit, and to apply a transformation matrix to the orientation of the first sensor unit when the orientation of the first sensor unit is not aligned with the first axis of rotation of the first sensor unit.

In some forms, the fourth axis is a fourth axis of rotation of the second sensor unit, and wherein the processor is configured to determine whether the second sensor unit is mounted to the body such that an orientation of the second sensor unit is aligned with the fourth axis of rotation of the second sensor unit, and to apply a transformation matrix to the orientation of the second sensor unit when the orientation of the second sensor unit is not aligned with the fourth axis of rotation of the second sensor unit.

In some forms, the seventh axis is a seventh axis of rotation of the third sensor unit, and wherein the processor is configured to determine whether the third sensor unit is mounted to the body such that an orientation of the third sensor unit is aligned with the seventh axis of rotation of the third sensor unit, and to apply a transformation matrix to the orientation of the third sensor unit when the orientation of the third sensor unit is not aligned with the seventh axis of rotation of the third sensor unit.

In some forms, the tenth axis is a tenth axis of rotation of the fourth sensor unit, and wherein the processor is configured to determine whether the fourth sensor unit is mounted to the body such that an orientation of the fourth sensor unit is aligned with the tenth axis of rotation of the fourth sensor unit, and to apply a transformation matrix to the orientation of the fourth sensor unit when the orientation of the fourth sensor unit is not aligned with the tenth axis of rotation of the fourth sensor unit.

In some forms, the processor is configured to filter the plurality of first, second, third and fourth signals.

In some forms, the processor is configured to determine: the rotational acceleration of the body using rotational velocity of the body; the rotational acceleration of the boom using rotational velocity of the boom; the rotational acceleration of the stick using rotational velocity of the stick; and the rotational acceleration of the bucket using rotational velocity of the bucket.

In some forms, the plurality of first signals include a GPS location of the body, and wherein the processor is configured to use: the first and second Euler angles to produce a first kinematic model of the body; the third and fourth Euler angles to produce a second kinematic model of the boom; the fifth and sixth Euler angles to produce a third kinematic model of the stick; the seventh and eighth Euler angles to produce a fourth kinematic model of the bucket; and combine the first, second, third and fourth kinematic models to produce a kinematic model of the production digger.

In some forms, the display is configured to display the kinematic model of the production digger.

Also disclosed herein is a system for tuning hydraulic components of a production digger, the production digger comprising an undercarriage configured to move the production digger, an body rotatably connected to the undercarriage, a boom rotatably connected to the body, a stick rotatably connected to the boom, a bucket rotatably connected to the stick, a first hydraulic component connected to the boom and the body that is configured to enable the boom to rotate relative to the body, a second hydraulic component connected to the boom and the stick that is configured to enable the stick to rotate relative to the boom, and a third hydraulic component connected to the bucket and the stick that is configured to enable the bucket to rotate relative to the stick. The system may comprise; one or more sensor units mounted to the boom, the stick, the body and/or the bucket, the one or more sensor units being configured to output one or more signals indicative of relative position, rotational velocity and/or rotational acceleration of the boom, stick, body or bucket respectively; and a processor in communication with the one or more sensor units, the processor being configured to: receive the one or more signals; and determine the relative position, rotational velocity and/or rotational acceleration of the boom, stick, body and/or bucket; a display in communication with the processor, the display being configured to: display tuning information to a user, the tuning information comprising the relative position, rotational velocity and/or rotational acceleration of the boom, stick, body and/or bucket determined by the processor, wherein the user is able to tune the first, second and/or third hydraulic component of the production digger in dependence on the tuning information.

Also disclosed herein is a system for assessing the kinematic performance of a production digger, the production digger comprising an undercarriage configured to move the production digger, an body rotatably connected to the undercarriage, a boom rotatably connected to the body, a stick rotatably connected to the boom, and a bucket rotatably connected to the stick. The system may comprise one or more sensor units mounted to the boom, the stick, the body, and/or the bucket, the one or more sensor units being configured to output one or more signals indicative of relative position, rotational velocity and/or rotational acceleration of the boom, stick, body or bucket respectively; and a processor in communication with the one or more sensor units, the processor being configured to: receive the one or more signals; an determine the relative position, rotational velocity and/or rotational acceleration of the boom, stick, body and/or bucket, wherein a user is able to assess the kinematic performance of the body, boom, body, stick, and/or bucket in dependence on the relative position, rotational velocity and/or rotational acceleration of the boom, stick, body and/or bucket determined by the processor.

Also disclosed herein is a method of tuning hydraulic components of a production digger, the production digger comprising an undercarriage configured to move the production digger, a body rotatably connected to the undercarriage about a first joint, a boom rotatably connected to the body about a second joint, a stick rotatably connected to the boom about a third joint, a bucket rotatably connected to the stick about a fourth joint, a first hydraulic component connected to the undercarriage and body that is configured to enable the body to rotate relative to the undercarriage, a second hydraulic component connected to the boom and the body that is configured to enable the boom to rotate relative to the body, a third hydraulic component connected to the boom and the stick that is configured to enable the stick to rotate relative to the boom, a fourth hydraulic component connected to the bucket and the stick that is configured to enable the bucket to rotate relative to the stick. The method may comprise; mounting a first sensor unit to the body of the production digger, the first sensor unit being configured to output a plurality of first signals indicative of a rotational velocity of the body about the first joint and a rotational acceleration of the body about the first joint; mounting a second sensor unit to the boom of the production digger, the second sensor unit being configured to output a plurality of second signals indicative of a rotational velocity of the boom about the second joint and a rotational acceleration of the boom about the second joint; mounting a third sensor unit to the stick of the production digger, the third sensor unit being configured to output a plurality of third signals indicative of a rotational velocity of the stick about the third joint and a rotational acceleration of the stick about the third joint; mounting a fourth sensor unit to the bucket of the production digger, the fourth sensor unit being configured to output a plurality of fourth signals indicative of a rotational velocity of the bucket about the fourth joint and a rotational acceleration of the bucket about the fourth joint; receiving at a computer processor the plurality of first, second, third and fourth signals; determining the rotational velocity of the body about the first joint, and rotational acceleration of the body about the first joint in dependence on the plurality of first signals using the computer processor; determining the rotational velocity of the boom about the second joint, and the rotational acceleration of the boom about the second joint in dependence on the plurality second signals using the computer processor; determining the rotational velocity of the stick about the third joint, and the rotational acceleration of the stick about the third joint in dependence on the plurality third signals using the computer processor; determining the rotational velocity of the bucket about the fourth joint, and the rotational acceleration of the bucket about the fourth joint in dependence on the plurality fourth signals using the computer processor; displaying on a display tuning information to a user, the tuning information comprising the rotational velocity and rotational acceleration of the boom, stick, body and bucket determined by the processor; and tuning the first, second, third and fourth hydraulic components of the production digger in dependence on the tuning information.

BRIEF DESCRIPTION OF DRAWINGS

Various embodiments/aspects of the disclosure will now be described with reference to the following figures.

DETAILED DESCRIPTION

Figure 1:
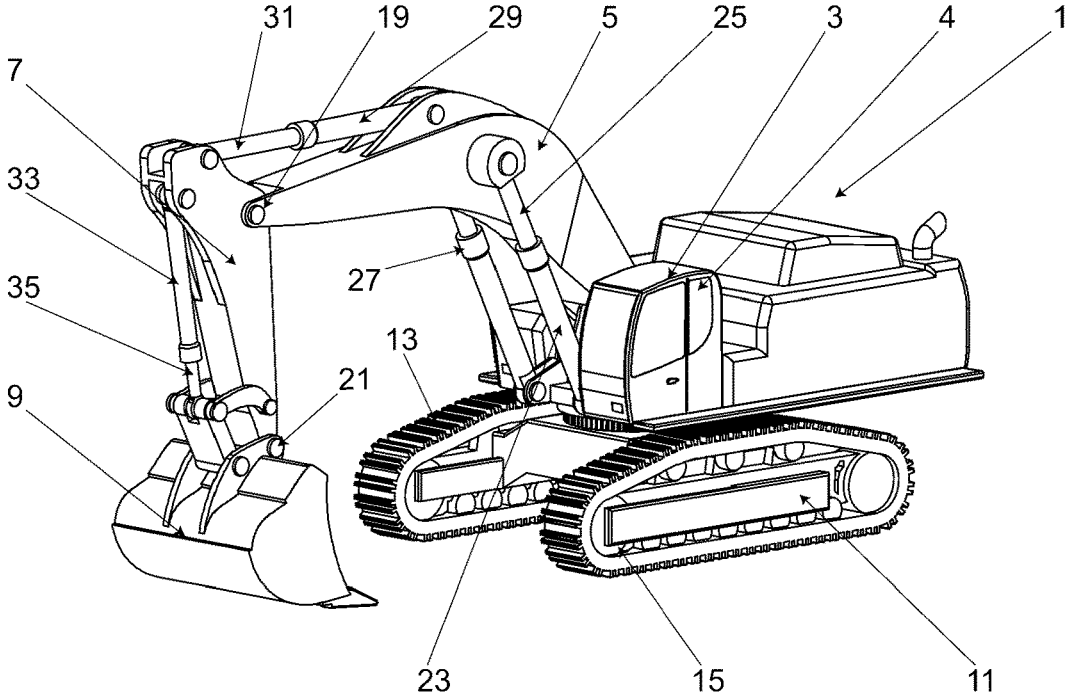
FIG. 1 provides a perspective view of a hydraulic excavator in accordance with an embodiment of the present disclosure.
Figure 2:
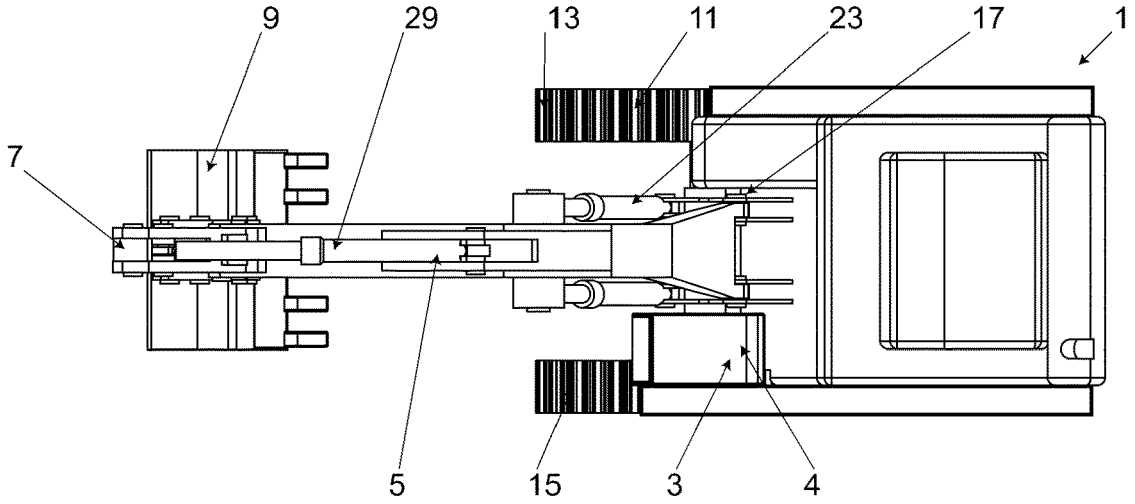
FIG. 2 provides a top view of the hydraulic excavator shown in FIG. 1.

Current practice among mining excavator manufacturers is to measure 'handbook' performance according to hydraulic pressures. As such, there is no consideration of actual kinematic performance of the production digger (e.g. hydraulic excavators, hydraulic mining shovels and backhoes). Through experimentation using the system disclosed herein, the Applicant has discovered significant variances in real production digger speeds of up to 28% between identical newly commissioned mining-scale production diggers.

When pressing the manufacturer in relation to this significant disparity in performance between identical production diggers (or between actual vs specified performance), a manufacturer may request a bench test in near-perfect digging conditions. Typically, an operator is provided by the manufacturer and a production test is carried out over a number of hours. The Applicant has discovered that this methodology has a significant number of variables and cannot be reasonably considered to be reliable or representative. The Applicant has discovered that this methodology cannot meaningfully isolate kinematic performance from the operator, material, bench configuration and truck exchange times to ensure production digger performance.

To address this problem, and the technical problems associated with the resulting sub-optimal performance of production diggers, the Applicant has developed a system that assesses production digger performance, allowing production digger operators (e.g. technicians, owners, maintenance personnel, original equipment manufacturers, etc) the ability to ensure that production diggers meet performance standards, both specified (e.g. timing of a movement between two positions) and unspecified (e.g. joint acceleration, a better performance characteristic than timing of a movement between two positions) by manufacturers (e.g. by rectifying the production digger to address mechanical issues, as is described further below, to physically change the way that the production digger operates). The system disclosed herein is able to separate the operator performance from production digger performance and allow operators to utilise an integrated performance management system that address the human and production digger components independently by measuring actual kinematic performance of the exicator through several mechanisms. Advantages of the system disclosed herein include that an production digger is able to be rectified (e.g. physical alterations to address issues determined by the system) to change the physical characteristics of the production digger (e.g. to increase productivity), there is no need for manufacturers to conduct the aforementioned bench testing, it allows for the performance of operator and production digger to be assessed, and can assess during normal digging (i.e. there may be no need to shut down and perform testing, reducing costly downtime).

A system that can used to substantially increase the performance of a production digger will now be described with reference to FIGS. 1 to 29.

FIG. 1 provides a perspective view of a hydraulic excavator 1. The excavator shown in FIG. 1 includes several components that are each configured to rotate with respect to one another; namely a body 3, which includes the operator station, or cab 4, a boom 5, a stick 7, a bucket 9, and an undercarriage 11. The undercarriage 3, which includes tracks 13, 15, is configured to move the excavator 1. The body 3 is rotatably connected to the undercarriage 11 about a first joint (16 in FIG. 7). The boom 7 is rotatably connected to the body 3 about a second joint 17. The stick 7 is rotatably connected to the boom 5 about a third joint 19. The bucket 9 is rotatably connected to the stick 7 about a fourth joint 21. A first hydraulic component (not shown) is connected to the undercarriage 11 and body 3. The first hydraulic component is configured to enable the body 3 to rotate relative to the undercarriage 11. A second hydraulic component 23 is connected to the boom 5 and the body 3. The second hydraulic component 23, which includes a pair of hydraulic actuators 25, 27 that are connected to either side of the boom 7, is configured to enable the boom 5 to rotate relative to the body 3. The third hydraulic component 29, which includes a hydraulic actuator 31, is connected to the boom 5 and the stick 7 and is configured to enable the stick 7 to rotate relative to the boom 5. The fourth hydraulic component 33, which includes a hydraulic actuator 35, is connected to the bucket 9 and the stick 7 and is configured to enable the bucket 9 to rotate relative to the stick 7.

Figure 3:
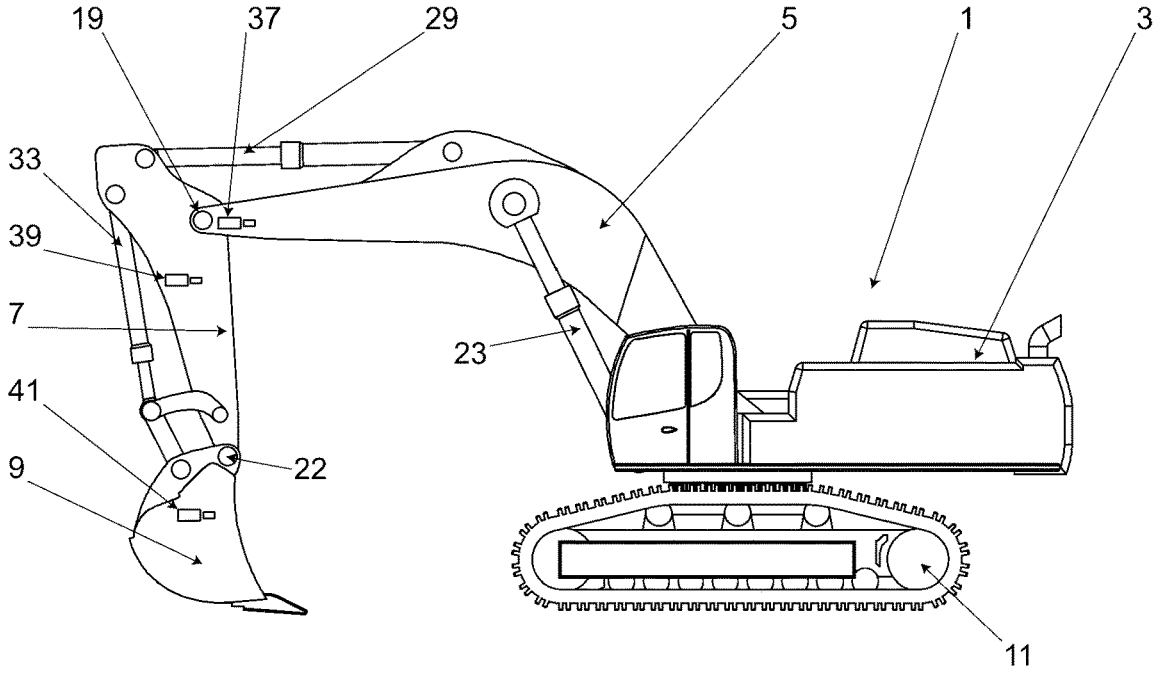
FIG. 3 provides a side view of the excavator shown in FIG. 1.
Figure 4:
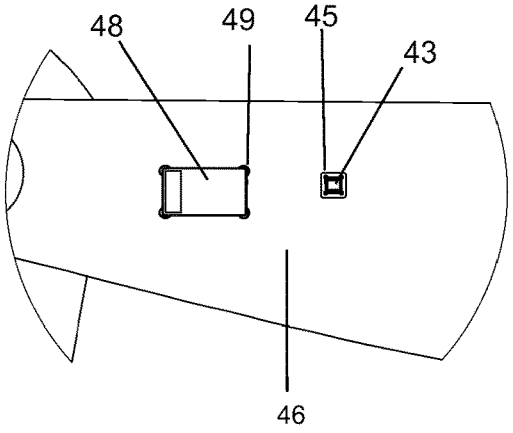
FIG. 4 provides a view of a sensor unit mounted to a component of the excavator shown in FIG. 1.

The system for tuning the hydraulic components will now be described in further detail with respect to FIG. 3. FIG. 3 provides a side view of the excavator. The system includes one or more sensor units. FIG. 4 provides a view of a sensor unit mounted to a component of the excavator in accordance with the present disclosure. In the embodiment disclosed in FIG. 3, the system includes first 37, second 39 and third 41 sensor units. In other embodiments (not shown), the system also includes a sensor unit that is mounted to the body 3. The first sensor unit 37 is mounted to the boom 5 of the excavator 1 and is configured to output signals that are indicative of the relative position of the boom 5, the rotational velocity of the boom 7 about the second joint 17, and/or the rotational acceleration of the boom about the second joint 17.

The third sensor unit 39 is mounted to the stick 7 of the excavator 1. The third sensor unit 39 is configured to output signals that are indicative of the relative position of the stick 7, the rotational velocity of the stick 7 about the third joint 19, and the rotational acceleration of the stick 7 about the third joint 19. The fourth sensor unit 41 is mounted to the bucket 9 of the excavator 1 and is configured to output signals indicative of the relative position of the bucket 9, the rotational velocity of the bucket 9 about the fourth joint 21, and the rotational acceleration of the bucket 9 about the fourth joint 21.

Figure 5:
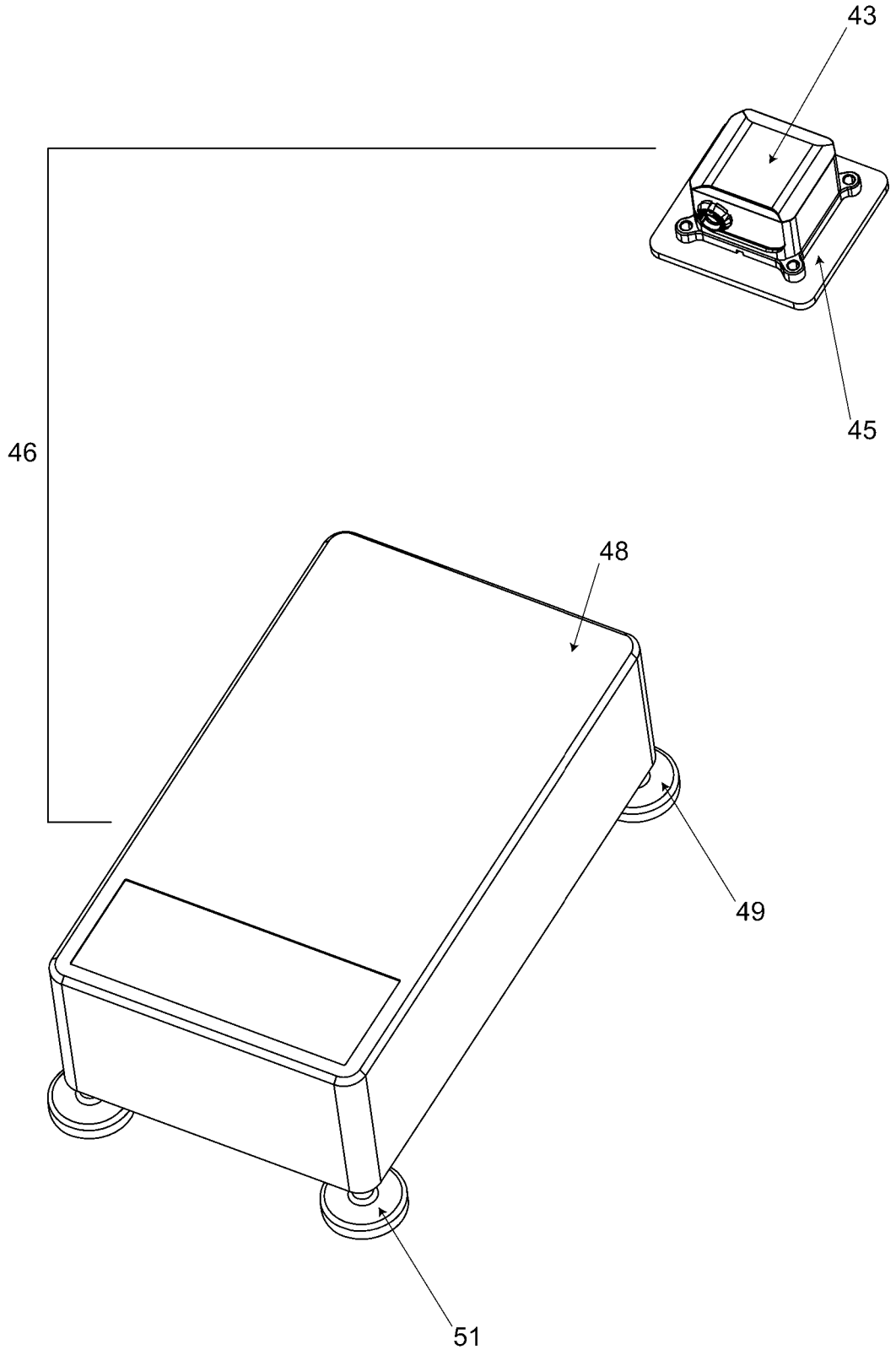
FIG. 5 provides a perspective view of a sensor unit shown in FIG. 4.
Figure 6A:
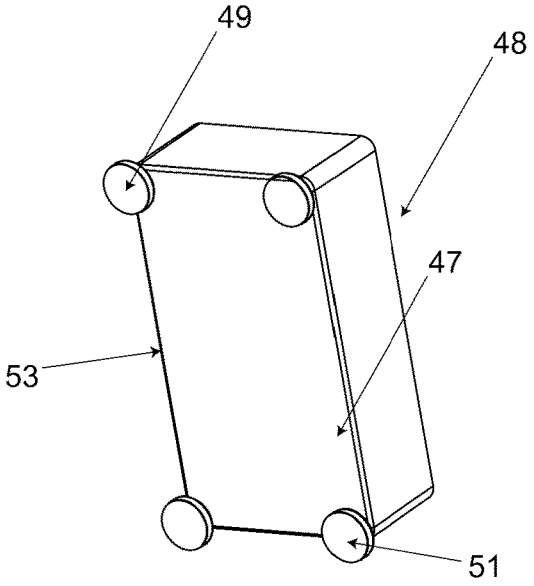
FIG. 6 provides an underside view of a sensor unit (a), an exploded view of the sensor unit (b), and a rear view of the sensor unit (c) shown in FIG. 4.
Figure 6B:
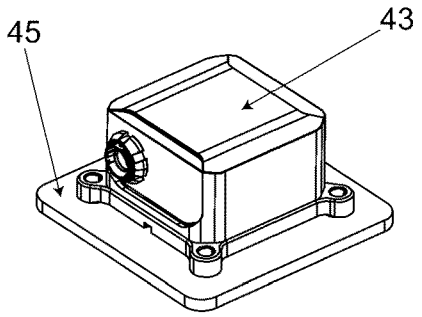
Figure 6C:
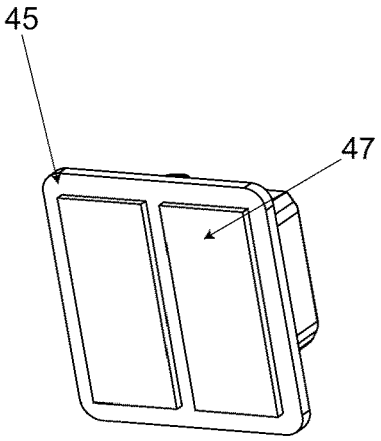

In the detailed embodiment, each of the sensor units are the same. A representative sensor unit 46 will now be described with respect to FIGS. 4 to 6. FIG. 4 provides a view of a sensor unit 46 mounted to a component of the excavator in accordance with the present disclosure. FIG. 5 provides a perspective view of a sensor unit 46. FIG. 6 provides several further views of the sensor unit 46. The sensor unit 46 includes a sensor 43 that is mounted to a mounting plate 45. As is shown in FIG. 6*c*, which provides a rear view of the mounting plate 45 of the sensor unit 46, the back of the mounting plate 45 includes adhesive strips 47 that enable the mounting plate 45 and sensor 43 to be detachably mounted to a component of the excavator 1. As will be apparent to the skilled addressee, alternate mounting (removable and fixed) means could be utilised to mount the mounting plate 45 to a component of the excavator.

The sensor unit 46 also includes a processor unit 48 that is in communication with the sensor unit 46. The processor unit 48 includes a computer processor. Communication between the processor unit 48 and the sensor 43 may be wireless or via a cable. In the detailed embodiment, the processor unit 48 is connected to the sensor 43 via a cable (not shown), and is located one or more meters away from the sensor 43 to reduce or eliminate the impact that magnets of the processor unit have on the measurements taken by the sensor 43 (e.g. distortion on the output of the sensor 43).

In the detailed embodiment, each sensor unit 46 includes a dedicated processor unit 47. Therefore, in an example where four sensor units are mounted to the body 3, boom 5, stick 7 and bucket 9 of the excavator 1, four processor units 48 associated with the sensor 43 of each sensor unit 46 is also mounted to body 3, boom 5, stick 7 and bucket 9 of the excavator 1. This arrangement provides several advantages. One advantage relates to the simplicity of the system. For example, each sensor 43 is designed such that it needs only to communicate with its dedicated processor unit 48, and not with sensors 43 that are mounted to other components of the excavator. Also, each sensor unit 46 and processor unit 48 may be the same (i.e. include the same sensor 43 and the processor of each processor unit is able to be configured in the same manner).

For performance assessment purposes, a user is able to mount one or more of the same sensor units to the excavator without needing to be concerned with issues relating to, for example, wireless connectivity between each of the sensor units, wireless connectivity between each of the sensor units and a processor that is separated from the excavator (e.g. a dedicated computer separate to the excavator that operates as the processor in lieu of one or more processor units), and having to mount different sensor configurations to different components of the excavator. However, while the detailed embodiment has the aforementioned advantages as they relate to system simplicity and practicality, as will be apparent to the skilled addressee, each sensor unit 46 need not include a dedicated processor unit 47. As will be apparent to the skilled addressee, a system having a single processor unit is also able to be implemented (e.g. a single processor unit that is either mounted to a component of the excavator, or separated from the excavator, and is configured to communicate with each sensor). As such, the term 'processor' as used herein refers to the functionality of one or more computer processors.

Each processor unit 48 includes a magnetic mounting means 49 that is configured to mount the processor unit 48 to a component of the excavator. In the detailed embodiment, the magnetic mounting 49 includes four magnets 51 that are secured to the corners of the rear face 53 of the processor unit 47.

In the detailed embodiment, the use of a detachable mounting for the mounting plate 45 and processor unit 48 enables the sensor units to be mounted to the components of the excavator for performance assessment purposes (e.g. when commissioning a new excavator, after servicing or repairing an excavator) and then removed from the components of the excavator such that the sensor units are not damaged in use.

In the detailed embodiment, the processor unit 47 includes onboard storage to enable data to be stored by the processor unit 47 (e.g. should a network not be available to transmit the data to another device, or should it be required to extract the data from the processor unit 47 at the completion of testing). In the detailed embodiment, the processor unit 47 is configured to communicate wirelessly (e.g. WiFi, cellular, etc.). External communication serves to provide remote access to the unit 47 for management to access the recorded data, and/or streaming of data to a centralized reporting database for further analysis and aggregation (e.g. to enable comparison and ranking of machines between operations).

As described above, the system includes a 'processor' (e.g. the functionality of one or more computer processors) in communication with the sensor units. In the detailed embodiment, the 'processor' includes the processor of the processor unit included in each of the first 37, second 39 and third 41 sensor units, along with the processor of a computer (not shown) that is separate to the processor units mounted to the excavator.

The processor is configured to receive the output signals of the first 37, second 39 and third 41 sensor units. The processor is configured to determine the relative position of the boom 5, the rotational velocity of the boom 5 about the joint 17, and the rotational acceleration of the boom 5 about the joint 17 in dependence on the output signals of the sensor unit mounted to the boom 5. The processor is also configured to determine the relative position of the stick 7, the rotational velocity of the stick 7 about the third joint 19, and the rotational acceleration of the stick 7 about the third joint 19 in dependence on the output signals of the sensor unit mounted to the stick 7. The processor is also configured to determine the relative position of the bucket 9, the rotational velocity of the bucket 9 about the fourth joint 21, and the rotational acceleration of the bucket 9 about the fourth joint 21 in dependence on the output signals of the sensor unit mounted to the bucket 9.

The system also includes a display (not shown) that is in communication with the processor. The display is configured to display tuning information to a user of the system. The tuning information includes the relative position, rotational velocity and rotational acceleration of one or more components of the excavator (e.g. boom 5, stick 7, body 3 and/or bucket 9) determined by the processor. The tuning information provides an accurate overview of the kinematic performance of each of the components of the hydraulic excavator. The user is able to compare the tuning information determined for the one or more components of the hydraulic excavator with data available for the type of excavator (e.g. data available for the kinematics of a type of hydraulic excavator provided by the excavator supplier). In this way, the user is able to tune the first, second 23, third 29 and/or fourth 33 hydraulic components of the excavator (e.g. by adjusting a pressure relief valve associated with a hydraulic actuator) in dependence on the tuning information. For example, if it is determined that one or more of the components of the hydraulic system are not moving as fast as theoretically achievable, the pressure relief valves and/or hydraulic solenoid associated with one or more of the hydraulic components could be adjusted to ensure a higher pressure is achieved.

Where the system includes a fourth sensor unit mounted to the body, the processor may alternatively, or in addition, be configured to determine the relative position of the body 3, the rotational velocity of the body 3 about the first joint, and the rotational acceleration of the body 3 about the first joint in dependence on output signals of the fourth sensor unit mounted to the body 3. In this embodiment, the processor is configured to receive the output signals of the fourth sensor unit to determine the relative position of the body 3, the rotational velocity of the body 3 about the joint between the undercarriage 11 and the body 3, and the rotational acceleration of the body 3 about that in dependence on the output signals of the sensor unit mounted to the body 3. In this embodiment, the processor is also configured to determine the relative position of the body 3, the rotational velocity of the body 3 about the joint between the body 3 and the undercarriage 11, and the rotational acceleration of the body 3 about that third joint in dependence on the output signals of the sensor unit mounted to the body 7. The tuning information displayed to the user would include the kinematic information determined by the processor for the body 3.

The sensors 43 and output of the sensors 43 will now be described in further detail with respect to FIG. 7. The sensor 43 of the sensor unit 46 when mounted to the body 3 (referred to below as the 'first sensor unit') includes a first gyroscope that is arranged to measure the angular velocity of the body 3 about a first axis $Z_0$ of the first joint (i.e. the rotatable mounting between the body 3 and the undercarriage 11—marked as 'joint 1' in FIG. 7). The signals of the first sensor unit are indicative of the angular velocity of the body 3 about the first axis $Z_0$. The sensor 43 of the first sensor unit may also include a magnetometer, an accelerometer and/or a GPS and an output of the sensor 43 may also include measurements of these sensors. The first sensor unit is arranged to measure the angular acceleration of the body 3 about the first axis $Z_0$ of the first joint. The signals of the first sensor unit are indicative of the angular acceleration of the body 3 about the first axis $Z_0$ of the first joint.

The first sensor unit is configured to output the plurality of first signals at between 1 Hz and 1 kHz (e.g. around 200 Hz). This provides a sufficient sampling rate for the purpose of assessing the kinematic performance of the body 3. As will be evident to the skilled addressee, the frequency is able to be selected to suit the overall system. In the detailed form, the signals outputted by the first sensor unit includes a timestamp.

The first sensor unit may be configured to determine first and second Euler angles of the first sensor, and signals outputted by the first sensor unit may then include the determined first and second Euler angles. The first and second Euler angles are able to be used in lieu of, for example, the output of the gyroscope in order to determine the rotational velocity and rotational acceleration of the body 3 about the joint between the body 3 and undercarriage 11.

The sensor 43 of the sensor unit 46 mounted to the boom 5 (referred to below as the second sensor unit, marked as 37 in FIG. 3) includes a gyroscope that is arranged to measure the angular velocity of the boom 5 about a second axis $Y_1$ of the second joint 17 (i.e. the rotatable mounting between the body 3 and the boom 5—marked as 'joint 2' in FIG. 7). The signals outputted by the second sensor unit are indicative of the angular velocity of the boom 5 about the second axis $Y_1$.

The sensor 43 of the second sensor unit may also include a magnetometer and an output of the sensor 43 may also include measurements of the magnetometer. The second sensor unit is arranged to measure the angular acceleration of the boom 5 about the second axis $Y_1$ of the second joint 17. The signals of the second sensor unit are indicative of the angular acceleration of the boom 5 about the second axis $Y_1$ of the second joint 17.

The second sensor unit is configured to output the plurality of the second signals at between 1 Hz and 1 kHz (e.g. around 200 Hz). This provides a sufficient sampling rate for the purpose of assessing the kinematic performance of the boom 5. As will be evident to the skilled addressee, the frequency is able to be selected to suit the overall system. In the detailed form, the signals outputted by the second sensor unit includes a timestamp.

The second sensor unit may be configured to determine third and fourth Euler angles of the second sensor, and signals outputted by the second sensor unit may then include the determined third and fourth Euler angles. The third and fourth Euler angles are able to be used in lieu of, for example, the output of the gyroscope in order to determine the rotational velocity and rotational acceleration of the boom 5 about the joint between the body 3 and boom 5.

Figure 7:
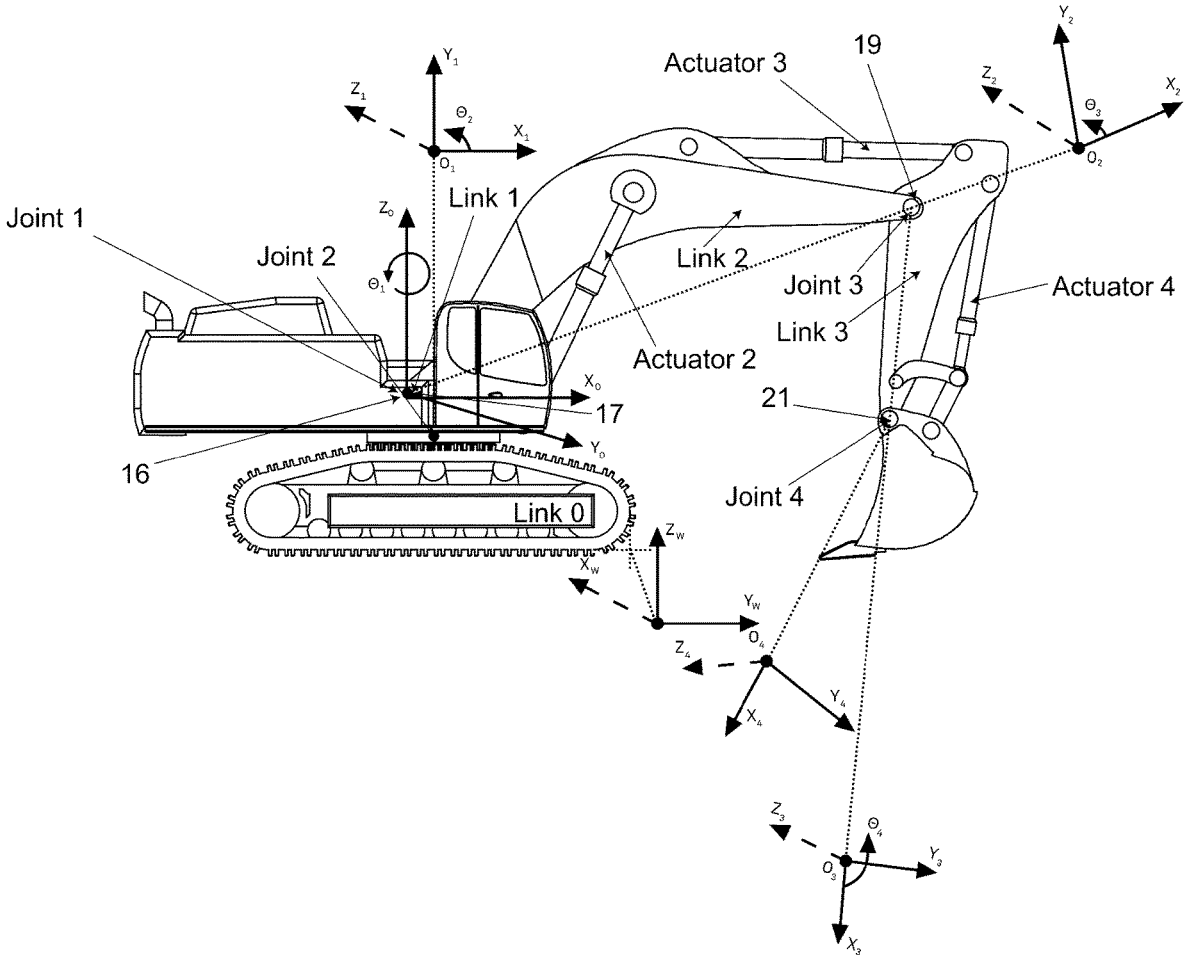
FIG. 7 provides depicts the sensors 43 and output of the sensors 43.

The sensor 43 of the sensor unit 46 mounted to the stick 7 (referred to below as the third sensor unit, marked as 39 in FIG. 3) includes a gyroscope that is arranged to measure the angular velocity of the stick 7 about a third axis $Y_2$ of the third joint 19 (i.e. the rotatable mounting between the boom 5 and the stick 7—marked as 'joint 3' in FIG. 7). The signals outputted by the third sensor unit are indicative of the angular velocity of the stick 7 about the third axis $Y_2$.

The sensor 43 of the third sensor unit may also include a magnetometer and an output of the sensor 43 may also include measurements of the magnetometer. The third sensor unit is arranged to measure the angular acceleration of the stick 7 about the second axis $Y_2$ of the second joint 17. The signals of the third sensor unit are indicative of the angular acceleration of the stick 7 about the third axis $Y_2$ of the third joint 19.

The third sensor unit is configured to output the plurality of second signals at between 1 Hz and 1 kHz (e.g. around 200 Hz). This provides a sufficient sampling rate for the purpose of assessing the kinematic performance of the stick 7. As will be evident to the skilled addressee, the frequency is able to be selected to suit the overall system. In the detailed form, the signals outputted by the third sensor unit includes a timestamp.

The third sensor unit may be configured to determine fifth and sixth Euler angles of the third sensor, and signals outputted by the third sensor unit may then include the determined fifth and sixth Euler angles. The fifth and sixth Euler angles are able to be used in lieu of, for example, the output of the gyroscope in order to determine the rotational velocity and rotational acceleration of the stick 7 about the third joint 19 between the stick 7 and boom 5.

The sensor 43 of the sensor unit 46 mounted to the bucket 9 (referred to below as the fourth sensor unit, marked as 41 in FIG. 3) includes a gyroscope that is arranged to measure the angular velocity of the bucket 9 about a fourth axis $Y_3$ of the fourth joint 21 (i.e. the rotatable mounting between the bucket 9 and the stick 7—marked as 'joint 4' in FIG. 7). The signals outputted by the fourth sensor unit are indicative of the angular velocity of the bucket 9 about the fourth axis $Y_3$.

The sensor 43 of the fourth sensor unit may also include a magnetometer and an output of the sensor 43 may also include measurements of the magnetometer. The fourth sensor unit is arranged to measure the angular acceleration of the bucket 9 about the fourth axis $Y_3$ of the fourth joint 21. The signals of the fourth sensor unit are indicative of the angular acceleration of the bucket 9 about the fourth axis $Y_3$ of the fourth joint 21.

The fourth sensor unit is configured to output the plurality of fourth signals at between 1 Hz and 1 kHz (e.g. around 200 Hz). This provides a sufficient sampling rate for the purpose of assessing the kinematic performance of the bucket 9. As will be evident to the skilled addressee, the frequency is able to be selected to suit the overall system. In the detailed form, the signals outputted by the fourth sensor unit includes a timestamp.

The fourth sensor unit may be configured to determine seventh and eighth Euler angles of the third sensor, and signals outputted by the fourth sensor unit may then include the determined seventh and eighth Euler angles. The seventh and eighth Euler angles are able to be used in lieu of, for example, the output of the gyroscope in order to determine the rotational velocity and rotational acceleration of the bucket 5 about the fourth joint 21 between the stick 7 and bucket 9.

Figure 8A:
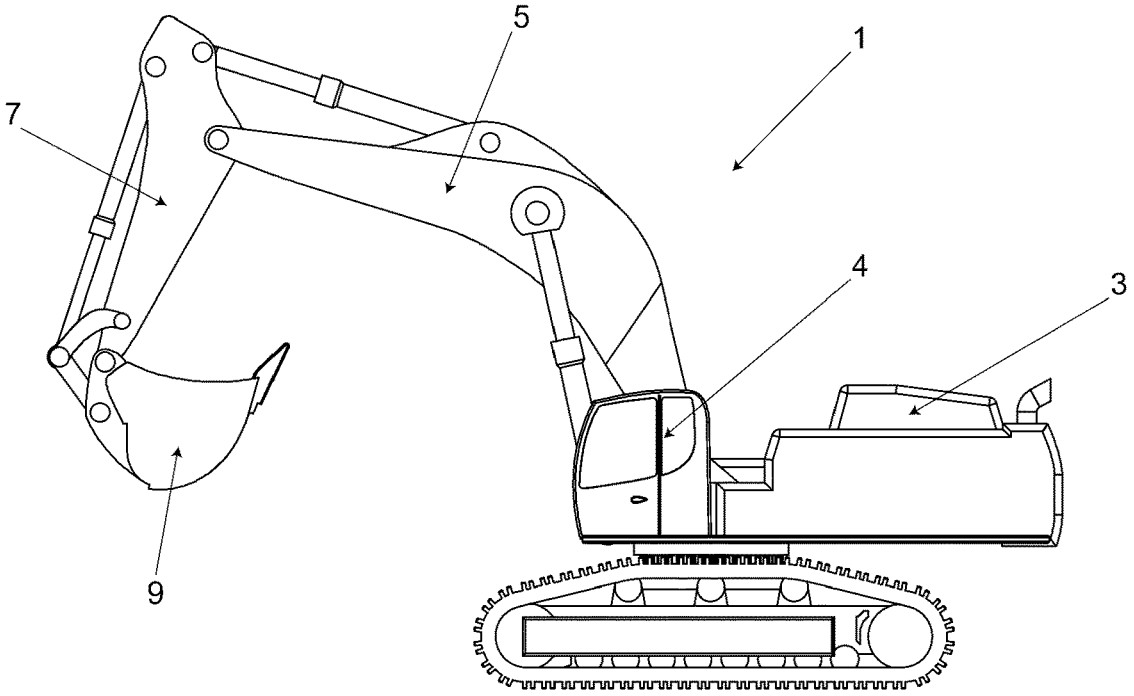
FIG. 8 provides another side view (a) and top view (b) of the excavator of FIG. 1.
Figure 8B:
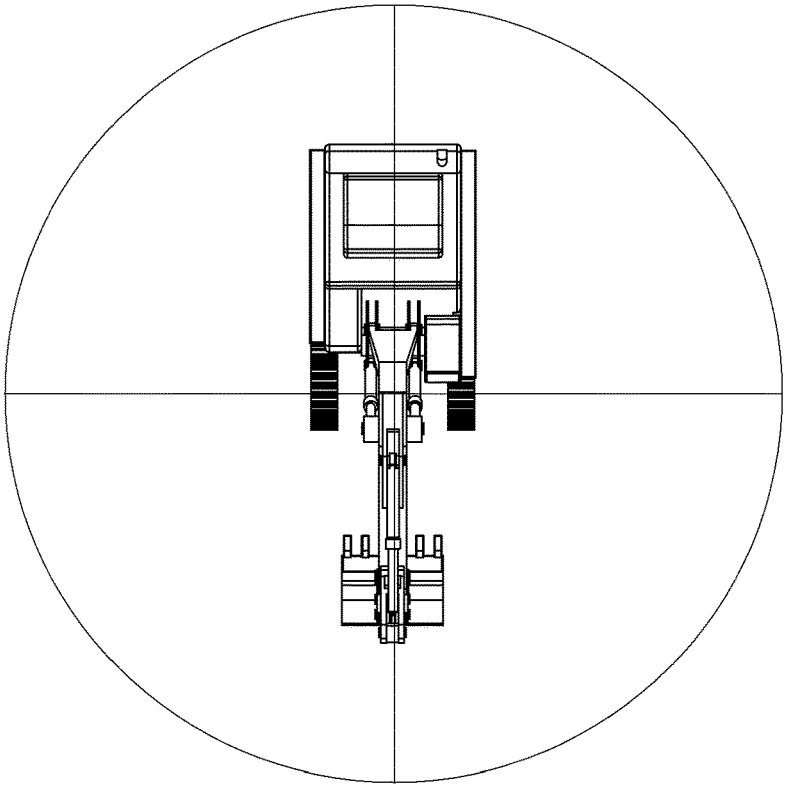
Figure 9A:
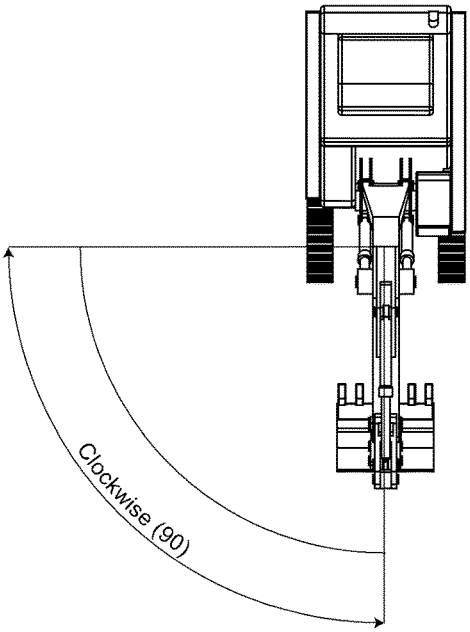
FIG. 9 provides further top views of the of the excavator shown in FIG. 1.
Figure 9B:
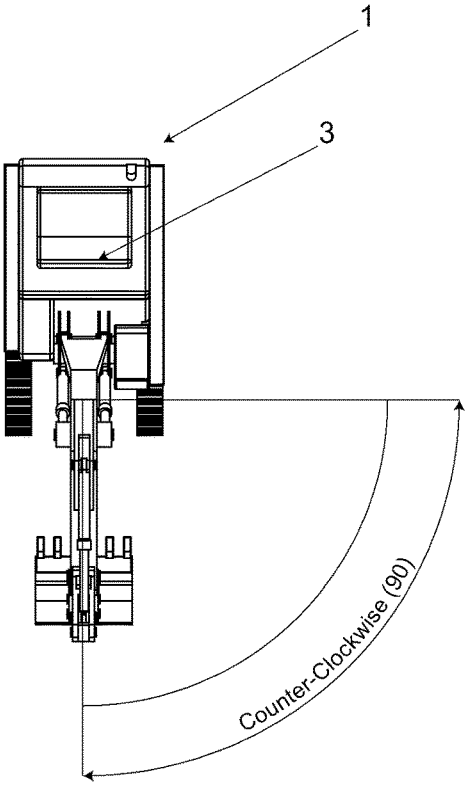
Figure 9C:
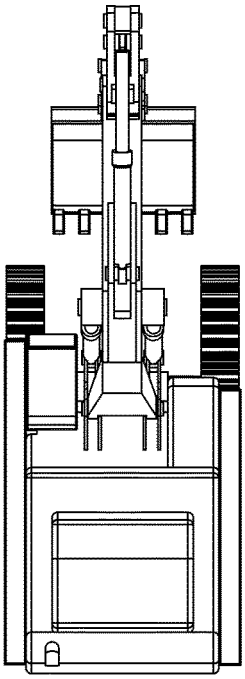
Figure 9D:
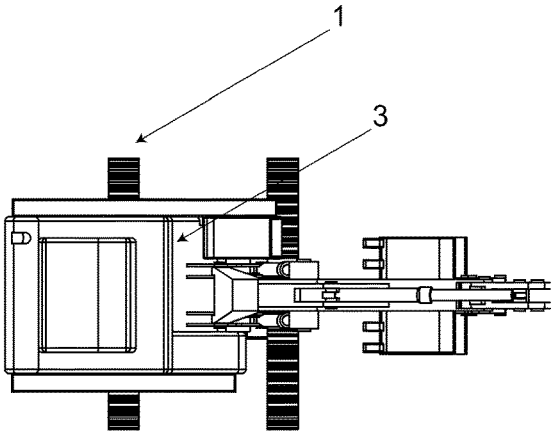

An example performance assessment procedure for the body 3 of the excavator will now be described with reference to FIGS. 8-15. FIG. 8*a* shows side view of the excavator in a typical starting position for performance assessment movements. FIG. 8*b* shows a top view of the excavator and indicates continuous rotational movements of the excavator (clockwise or counter clockwise). FIGS. 9*a-b* show top views of the excavator 1 and indicates movements of the body 3 in the clockwise (FIG. 9*a*) and counter clockwise (FIG. 9*b*) directions. FIGS. 9*c-d* show top views of the excavator 1 and indicates the starting position of the excavator for performance assessment purposes (FIG. 9*c*) and the end position (FIG. 9*d*) of the excavator following the completion of a 90 degree rotation in a clockwise direction from the position shown in FIG. 9*c*.

An example procedure for the performance assessment of the body 3 of the excavator 1 is as follows. Firstly, specific movements of the body 3 of the excavator 1 are performed by an operator. After bringing the excavator up to full operating RPM, the operator positions the attachment in a typical loading position (shown in FIG. 8*a*) with the bucket 9 level with the cab 4. The operator then performs the following yaw movements ('slew'). Slew is an important movement of an excavator as it where the excavator spends most of its time (e.g. two slewing operations per load: one to load a truck with a bucket and another to return to the dig face).

Starting from a stationary position at the 12 o'clock position (shown in FIG. 8*b*), in a single action, the operator performs six rotations clockwise (turning left), applying full control. The operator then performs the same operation is the opposite direction: six rotations counter-clockwise (turning right). The operator may then perform a front to side counter slew. The front to side counter slew is shown in FIGS. 9*a-d*. Again from a 12 o'clock position starting position, with the bucket diggers attachment positioned the in the test position described above (shown in FIG. 9*c*), the operator slews approximately 90 degrees (shown in FIG. 9*d*) and then immediately slews back to the starting position. The operator repeats this movement continuously 3 times and ensures that full counter slew is applied. This procedure is repeated for clockwise and counter-clockwise movements. In some forms, only two or three turns are required (as opposed to the six referenced above). Maximum velocity is typically reached within 120 degrees when slewing. In some forms, a signal (e.g. an audible noise, a displayed message on a display) will communicate when maximum velocity (e.g. an angular rotation that typically corresponds with maximum velocity) is reached and guide the operator through the test sequences as the position of the machine is known.

Figure 10:
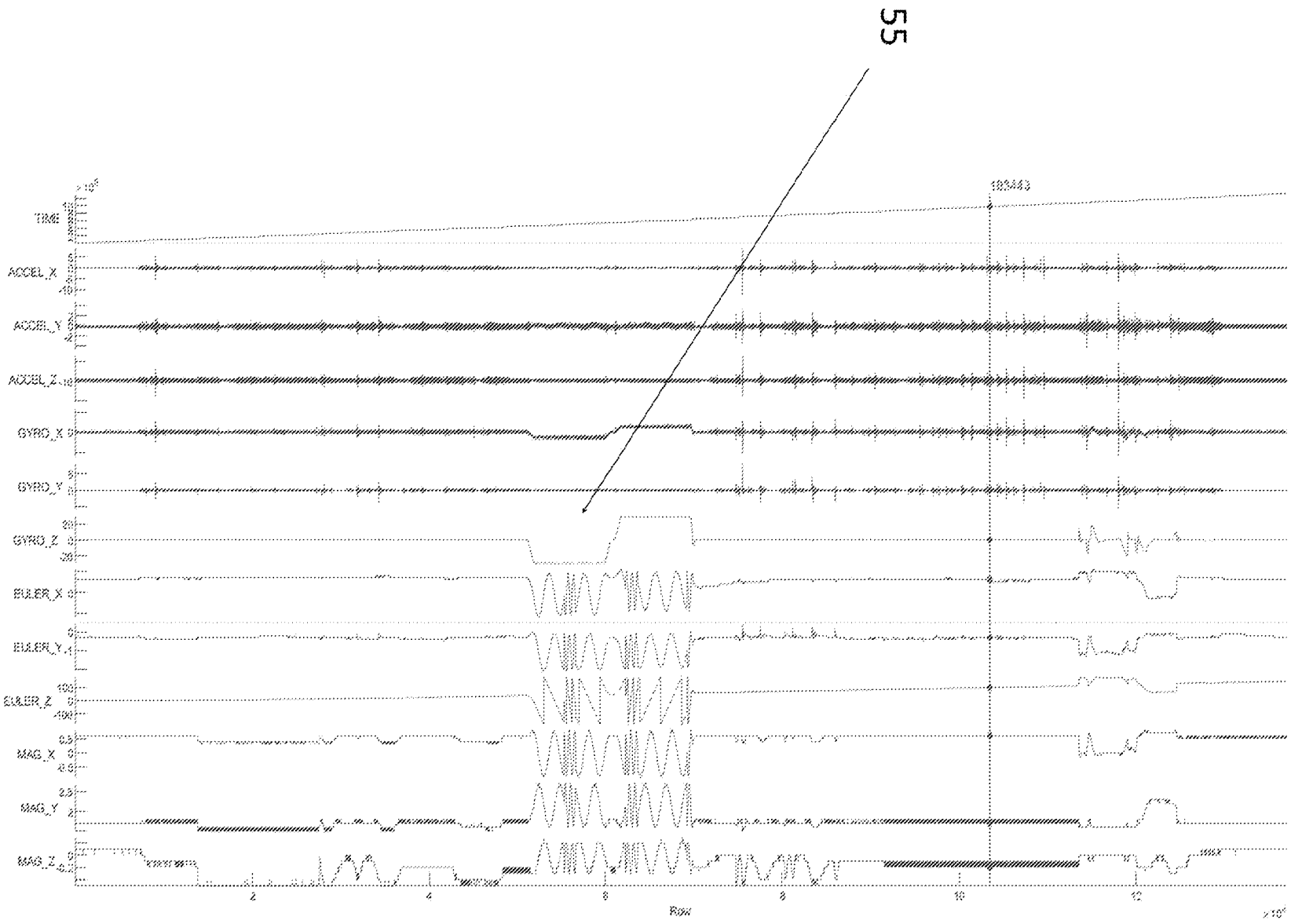
FIG. 10 shows the output of the first sensor unit according to an embodiment of the present disclosure.
Figure 11A:
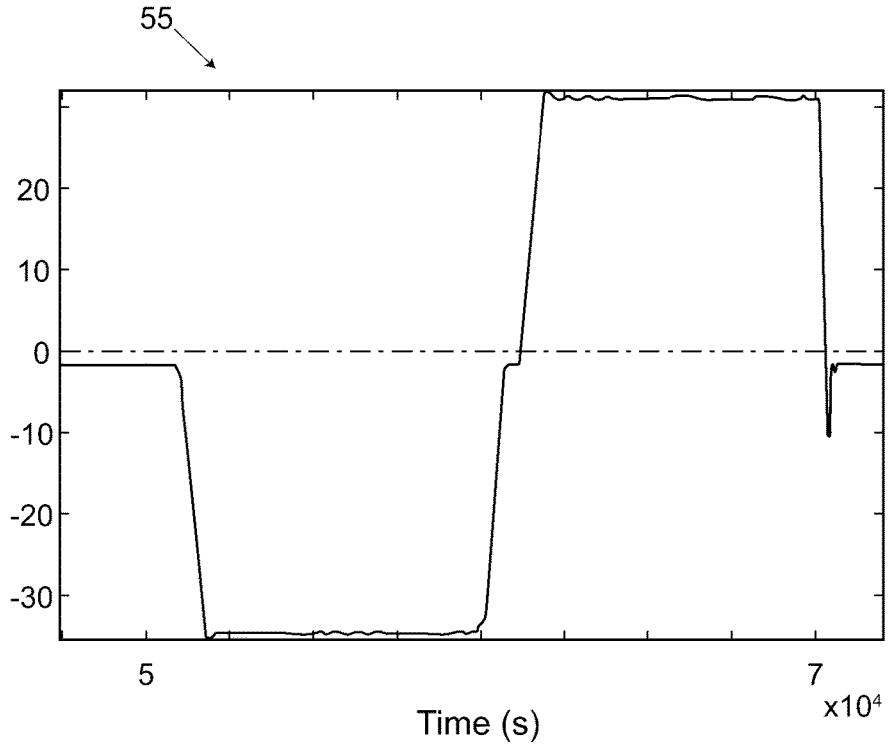
FIG. 11 shows regions of interest in the signal outputs shown in FIG. 10.
Figure 11B:
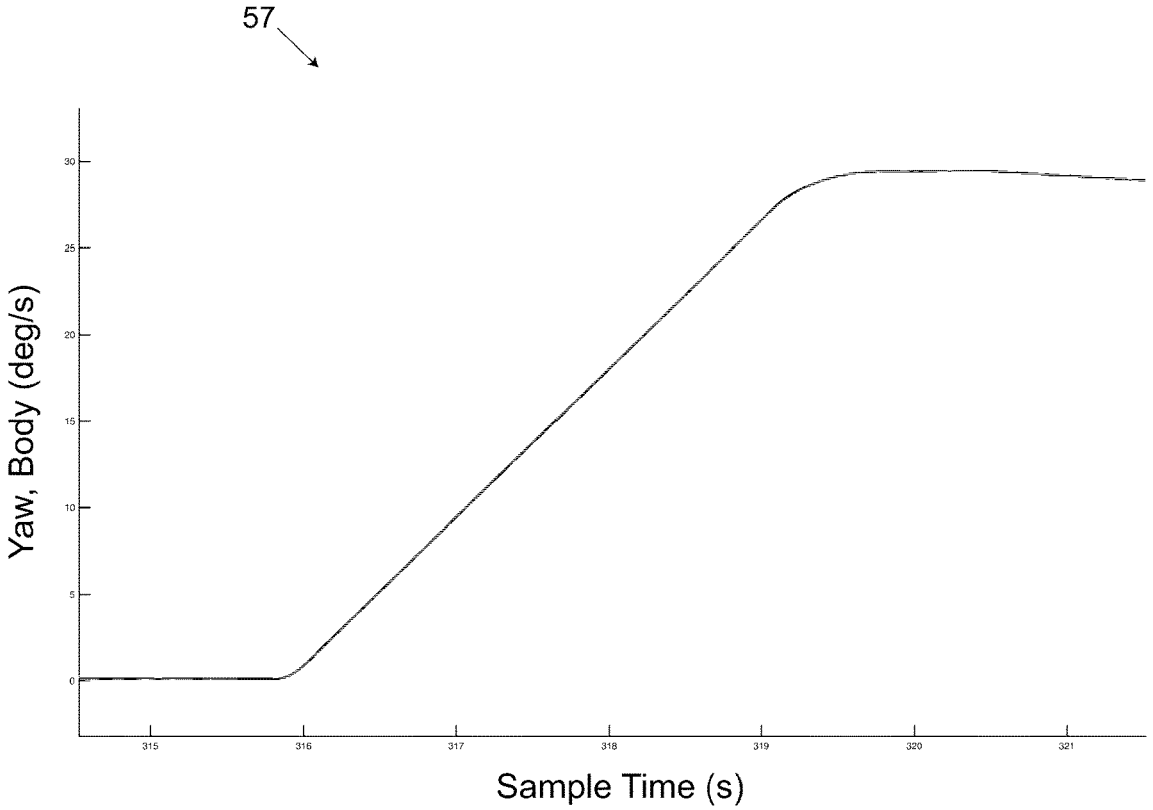

The processor is configured to compile the plurality of first signals to produce a first graph that plots the plurality of first signals against time. The first graph may be in the form of several graphs that plot, or otherwise represent, each of the outputs of the first sensor unit against time. An example of the first graph is shown in FIG. 10. FIG. 10 shows the output of the first sensor unit, which includes, by way of example only, time, rotational acceleration about three perpendicular axes, outputs of the gyroscope (e.g. rotational velocity about three perpendicular axes), Euler angles and magnetometer readings over time. The output marked as 'GYRO_Z' corresponds to the rotational velocity of the body about the first axis $Z_0$ of the first joint (see FIG. 7). This is also referred to as 'Yaw' of the body 3 and may be expressed in degrees/second.

The processor is configured to determine a first region of interest 55 in the first graph that represents a rotational movement of the body 3 about the first axis $Z_0$ of the first joint. As can be seen in the first region of interest 55 in FIG. 10, the output marked as 'GYRO_Z' in the first region of interest 55 corresponds to two separate movements of the body 3 (e.g. a clockwise movement, followed by an anti-clockwise movement of the body 3 about the first axis $Z_0$ of the first joint). The processor is configured to isolate the first region of interest 55 (see FIG. 11*a*) and then further magnify a portion 57 (see FIG. 11*b*) of the first region of interest 55 that corresponds with a rotation of the body 3 in one direction (e.g. anticlockwise). The processor is configured to determine the rotational velocity and rotational acceleration of the body 3 in the first region of interest 55 using the portion 57. For example, in the example provided in FIGS. 8-9, the processor is able to determine that the rotational velocity, or 'yaw', of the body 3 is maximum of around 30 degrees/second. The processor is configured to filter the signals received from the first sensor unit and apply a smoothing spline fit to the data. The processor is further configured to apply a derivative to the rotational velocity in order to determine the rotational acceleration of the body 3. The display is configured to display the rotational velocity and rotational acceleration of the body 3 in the first region of interest 55.

Figure 12:
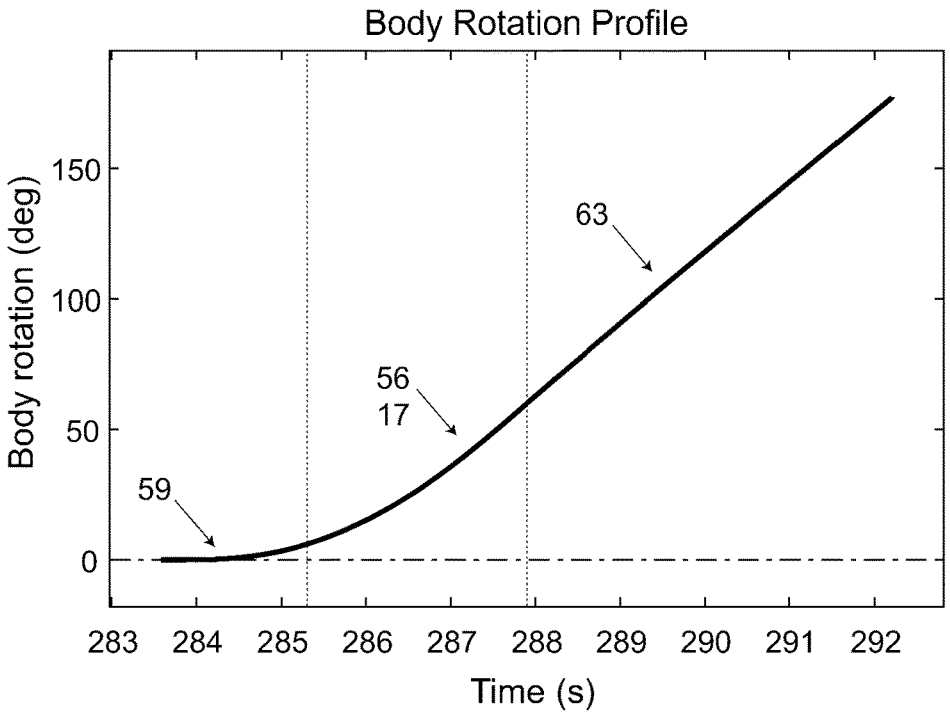
FIG. 12 shows an example of an output of the system for the assessment of slewing displacement of the excavator of FIG. 1.

FIG. 12 provides another example of an output of the system for the assessment of slewing displacement of the excavator body 3. FIG. 12 provides a graph of displacement (y-axis) v time (x-axis). Initially, the body 3 is stationary (region 59). As the body begins to rotate (region 61), the body accelerates towards a maximum speed, which is achieved after a period of time (region 63). The system is configured to determine and track the following key measurements for slewing displacement, which are useful characteristics to assess cab performance:

time taken to reach maximum rotational velocity for the body;

maximum rotational velocity value for the body; and the rotational acceleration of the body.

Figure 13:
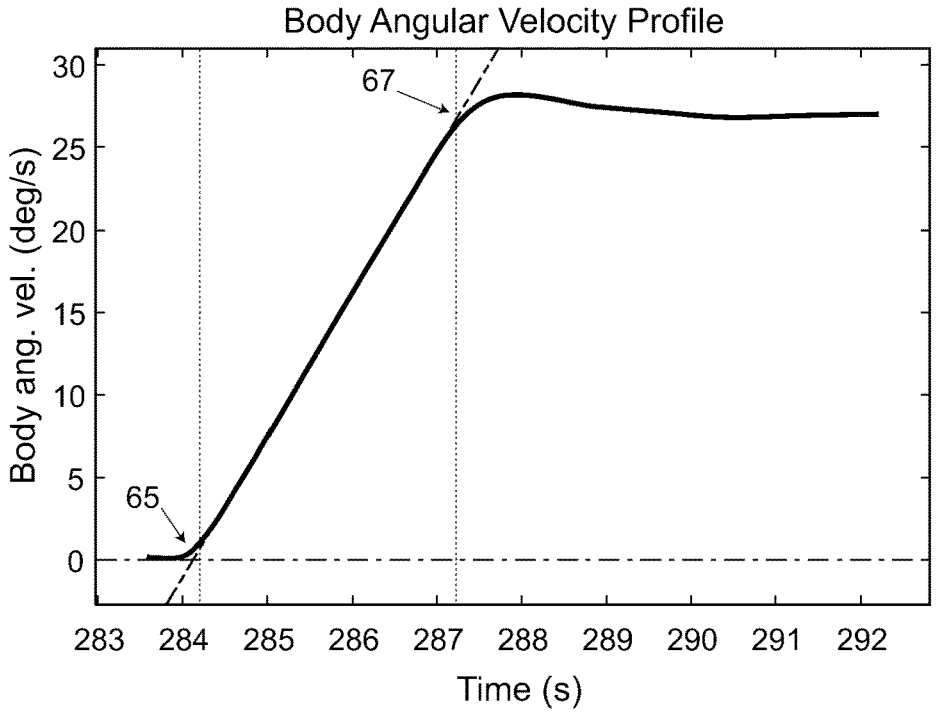
FIG. 13 provides a graph of rotational velocity associated with the output shown in FIG. 12.
Figure 14:
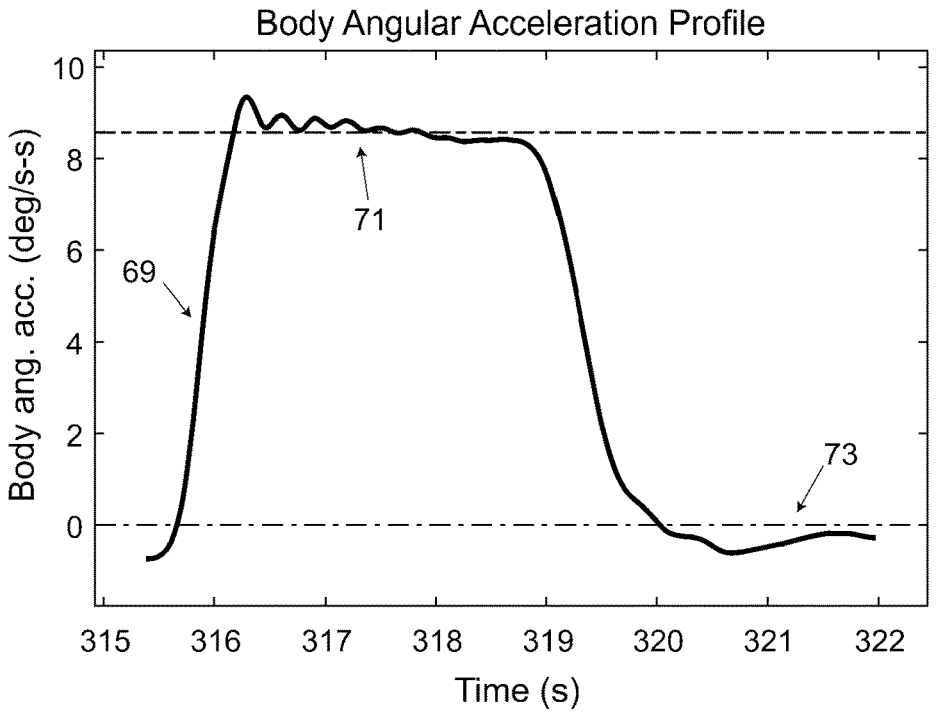
FIG. 14 provides a graph of slewing acceleration obtained by differentiation of the curve shown in FIG. 13.

FIGS. 13 and 14 provide another example of an output of the system for the assessment of slewing displacement of the excavator body 3. FIG. 13 provides a graph of rotational velocity (y-axis) v time (x-axis). Slewing acceleration is taken by differentiation of the curve shown in FIG. 13 and yields the graph shown in FIG. 14. While a linear acceleration can be fitted (e.g. region 63 of the graph shown in FIG. 15 above), the determined "Knee's" (regions 65 and 67 in FIG. 13) are critical for comparison to define how the excavator overcomes static frication and to enable identification of other modes of failure or degradation in excavator performance which would otherwise be neglected by a linear approximation (e.g. straight-line fit). The regions identified in the graph provided in FIG. 14, which shows degrees/second$^2$ (y-axis) v time (x-axis), correspond with rapidly increasing acceleration (region 69), peak acceleration (region 71), and constant velocity (region 73).

Figure 15:
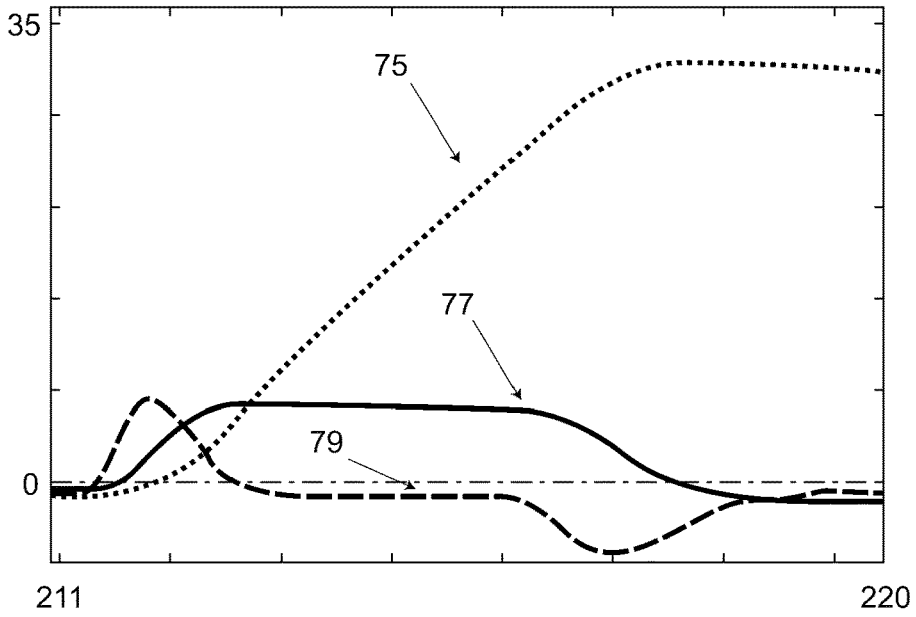
FIG. 15 provides a representative output of jerk obtained from the data represented in FIG. 14.

The system may also be configured to determine a derivative of rotational acceleration to determine the jerk of each joint. A graph that provides a representative output of jerk is shown in FIG. 15, which shows a comparison between yaw velocity (first derivative) 75 over time (y-axis), yaw acceleration (second derivative) 77 over time, and yaw jerk (third derivative) 79 over time. Should it be required to investigate a 'jerky' response, again, the system is configured to enable this investigation by taking the derivative of acceleration. This is useful to investigate operators claims of a 'jerky excavator' and quantify those claims through precise dynamic measurements (e.g. rather than feel). In one embodiment of the present disclosure, the system disclosed herein is configured to determine this useful metric for all joints and movements to provide an ongoing mechanical analysis and enable operator training to smooth machine control inputs in order to minimise jerk forces.

The Applicant has discovered that setting the pressure and flow of hydraulic components (such as the hydraulic component configured to enable rotation of the body relative to the undercarriage of the excavator) to specified values is not an optimum method for maintaining and commissioning a hydraulic excavator. This traditional method may not result in the optimal (e.g. as specified by a manufacturer) performance. The system disclosed herein advantageously enables the kinematic performance of the body of a hydraulic excavator to be assessed dynamically. In the event that the kinematic performance is not optimal, the operator (this may be via the equipment provider) is able to adjust the hydraulic component associated with the rotation of the body (e.g. away from the settings specified by the manufacturer to achieve a specified performance). As such, the performance of the hydraulic excavator is able to be optimised (e.g. to move faster) using the system disclosed herein, which provides many benefits to the user of the excavator. Also, it enables the operator and the excavator to be assessed independently of one another, which removes human error from the assessment of the performance of an excavator, enables operators to be further educated to increase performance, and enables tracking of operator performance in addition to excavator performance.

In regards to "optimal kinematic performance" of a production digger, it should be noted that original equipment manufacturers (OEMs) do not typically provide a specification for rotational velocity or rotational acceleration directly. As discussed above, OEMs typically only provide a specified time taken to perform a test movement with one and or both engines (if the machine has two engines) in operation. This methodology provided by the OEMs assumes constant and uniform rotational acceleration and rotational velocity, which again the Applicant has discovered does not reflect real world results for the reasons discussed above (e.g. due to non-conservative damping coefficients, etc.). When conducting one of the OEM tests, two different machines could have different joint velocities and accelerations while still producing the same resultant time to complete a specified movement. The system disclosed herein actually characterises performance for a more detailed overview by defining actual machine performance.

Figure 16A:
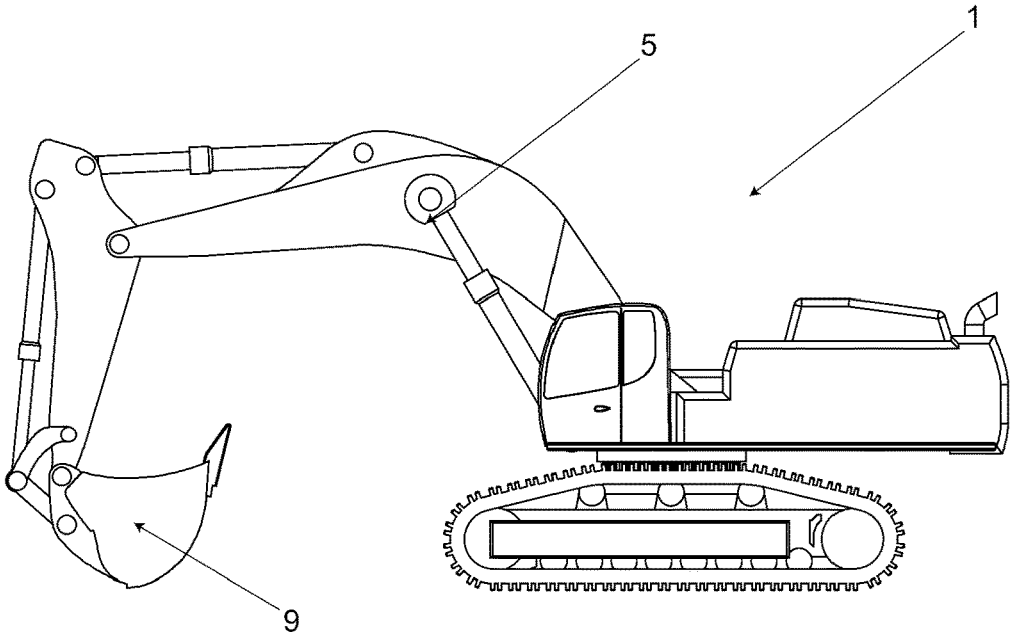
FIG. 16 shows further side views of the excavator shown in FIG. 1.
Figure 16B:
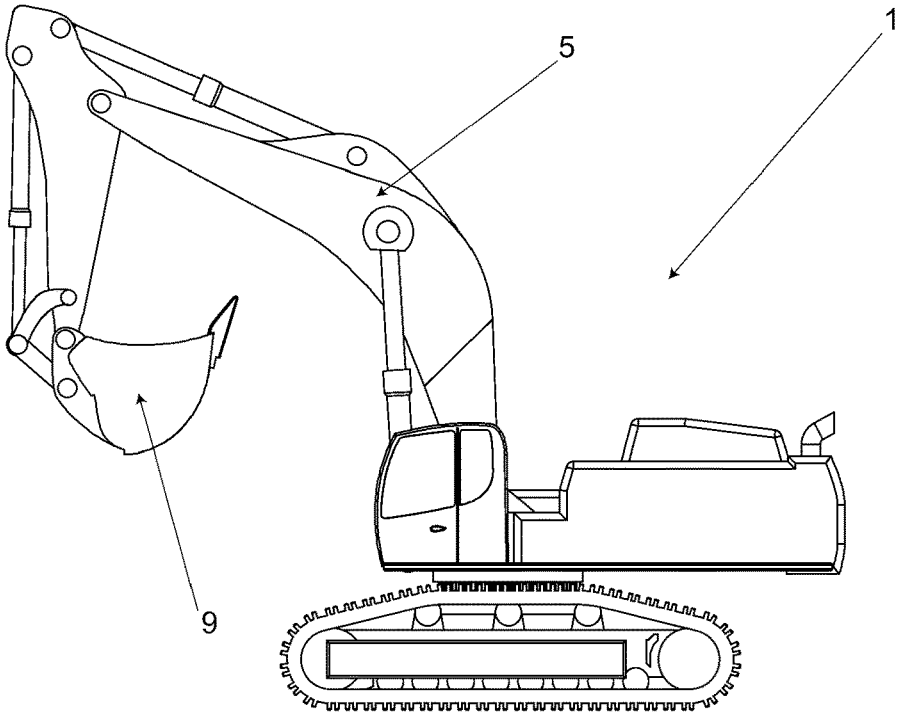

An example performance assessment procedure for the boom 5 of the excavator will now be described with reference to FIGS. 16-19. FIG. 16*a* shows a side view of the excavator in a typical starting position for performance assessment movements, with the boom 5 in a lowered position. FIG. 16*b* shows a side view of the excavator in a typical end position for performance assessment movements, with the boom 5 in the raised position.

An example procedure for the performance assessment of the boom 5 of the excavator 1 is as follows. Firstly, specific movements of the boom 5 of the excavator 1 are performed by an operator. Starting with the bucket 9 curled fully in (i.e. towards the boom 5) and positioned just off the ground, the boom 5 is raised at maximum lever application until just before the boom end stops are reached (shown in FIG. 16*b*). The boom 5 is then lowered in the same manner back to the starting position (shown in FIG. 16*a*). This procedure is typically performed in a repetitive manner (e.g. approximately six times).

Figure 17:
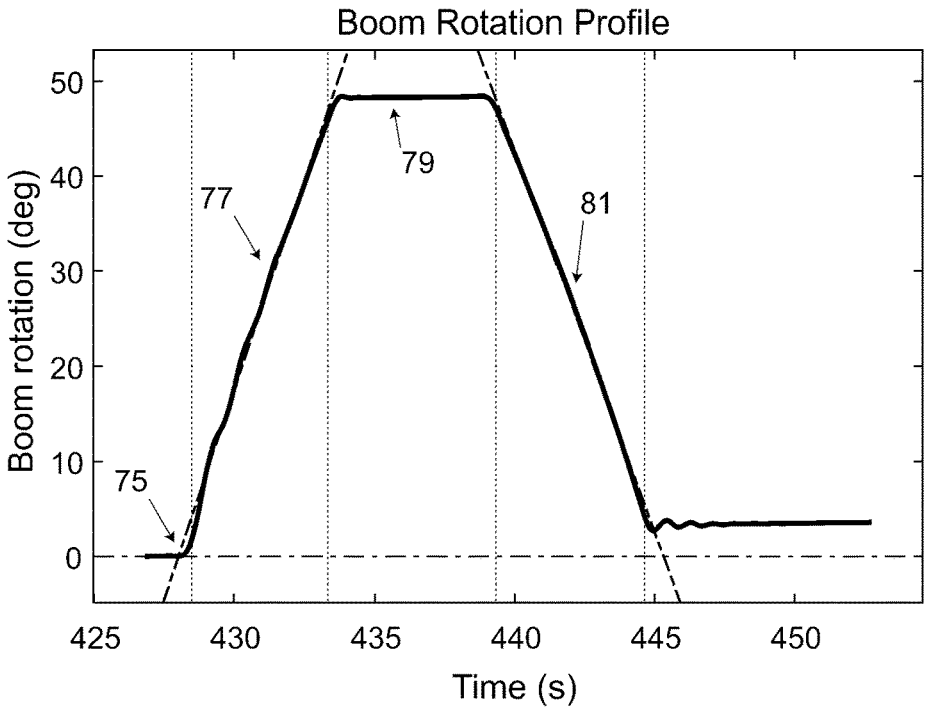
FIG. 17 shows the angular displacement of the boom according to an embodiment of the present disclosure.

The processor is configured to compile the plurality of second signals to produce a second graph that plots the plurality of second signals against time. The second graph may be in the form of several graphs that plot, or otherwise represent, each of the outputs of the second sensor unit against time. An example of the first graph is shown in FIG. 17, which shows the angular displacement of the boom 5 (relative angular displacement on the y-axis v time on the x-axis). The outputs of the second sensor unit is similar to that described above for the first sensor. Similar to the output of the first sensor, the output of the second sensor includes a measurement referred to as 'GYRO_Y', which corresponds to the rotational velocity of the boom about the second axis $Y_1$ (see FIG. 7) of the second joint 17 (see FIG. 2).

In a similar manner (not shown) to that described above with respect to the first sensor, the processor is configured to determine a region of interest in the graph of the second sensor outputs that represents a rotational movement of the boom 5 about the second axis $Y_1$ of the second joint.

As shown in FIG. 17, the boom 5 moves through four positions that includes lifted and stationary (region 75), which corresponds with the position of the boom shown in FIG. 16*b*, 'boom down' (i.e. the boom moving down from the position shown in FIG. 16*b* to the position shown in FIG. 16*a*—region 77), lowered and stationary (region 79) and 'boom up' (i.e. the boom moving up from the position shown in FIG. 16*a* to the position shown in FIG. 16*b*—region 81). Moving the boom from the lowered to raised position ('boom up') is typically slower than moving the boom from the raised to the lowered position ('boom down'), due to having to gravity. The system is configured to determine and track the following key measurements for displacement of the boom, which are useful characteristics to assess boom performance:

- time taken to reach maximum rotational velocity for the boom being raised and lowered;
- maximum rotational velocity value for the boom being raised and lowered; and the rotational acceleration for the boom being raised and lowered.

Figure 18:
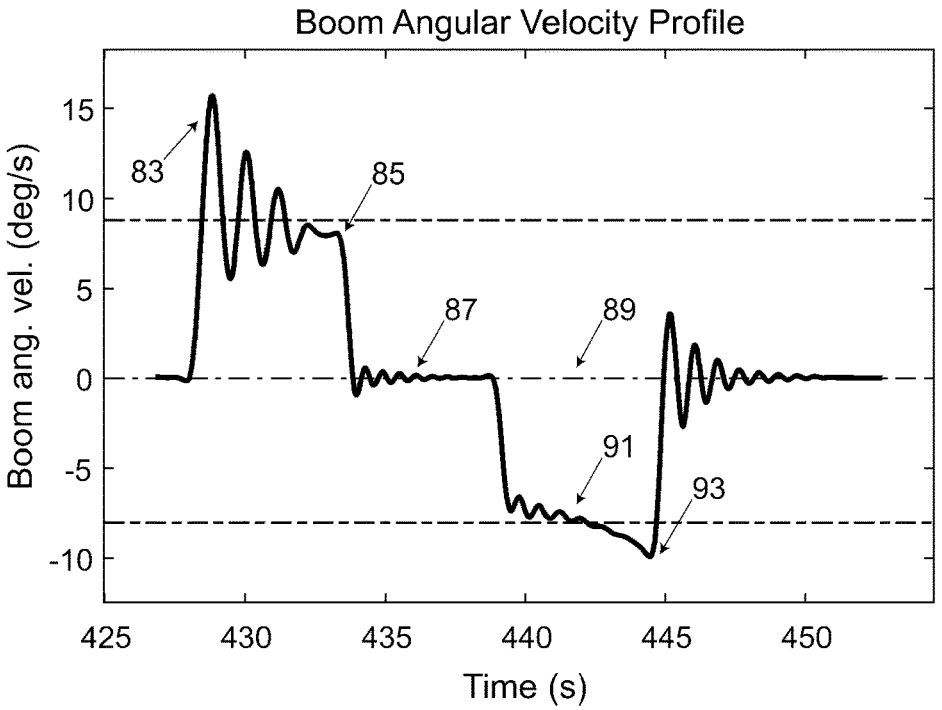
FIG. 18 provides an example of an output of the system for the assessment of displacement of the boom shown in FIG. 17.

FIG. 18 provides another example of an output of the system for the assessment of displacement of the boom 5. FIG. 18 provides a typical graph of rotational velocity (degrees/second on the y-axis) v time (x-axis) for the boom assessment procedure. The maximum velocity for 'boom down' marked as 83, region 85 corresponds with 'boom down', region 87 corresponds with typical oscillations of the boom as it reaches the lowered position (the settling time for the boom typically increases as the excavator ages and there is more 'slop' in the components as seals age), region 89 corresponds with 'boom-up', region 91 corresponds with the typical oscillation of the boom during 'boom-up', and the maximum velocity for 'boom-up' is marked as 93.

Figure 19:
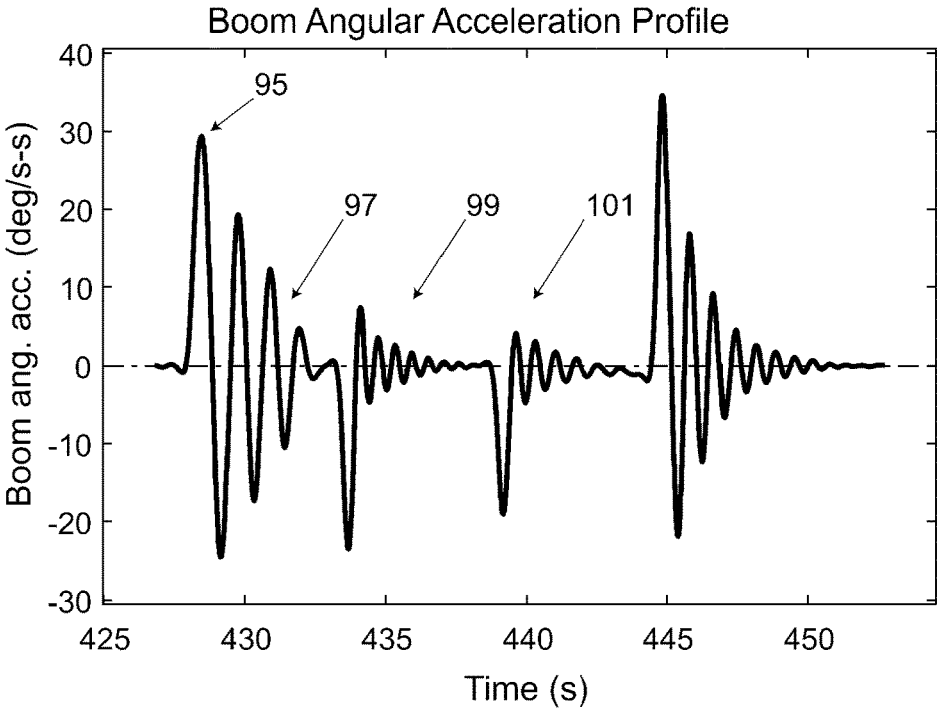
FIG. 19 provides a graph of the rotational acceleration for the boom obtained by differentiation of the curve shown in FIG. 18.

Rotational acceleration for the boom is obtained by differentiation of the curve shown in FIG. 18 and yields the graph shown in FIG. 19. The regions identified in the graph provided in FIG. 19, which shows degrees/second2 (y-axis) v time (x-axis), correspond with peak acceleration (95), boom down 97, boom stationary/settling 99 and boom up 101 (note 'jerky' motion in the region 'boom up' 101).

Similar to that described above with respect to the body, the Applicant has discovered that setting the pressure and flow of hydraulic components (such as the hydraulic component configured to enable rotation of the boom relative to the body of the excavator) to specified values is not an optimum method for maintaining and commissioning a hydraulic excavator. This traditional method may not result in the optimal (e.g. as specified by a manufacturer) performance. The system disclosed herein advantageously enables the kinematic performance of the boom of a hydraulic excavator to be assessed dynamically. In the event that the kinematic performance is not optimal (e.g. not achieving the specified rotational velocity and acceleration), the operator (this may be via the equipment provider) is able to adjust the hydraulic component associated with the rotation of the boom (e.g. away from the settings specified by the manufacturer to achieve a specified performance). As such, the performance of the hydraulic excavator is able to be optimised (e.g. to move faster) using the system disclosed herein, which provides many benefits to the user of the excavator. Also, it enables the operator and the boom to be assessed independently of one another, which removes human error from the assessment of the performance of an excavator, enables operators to be further educated to increase performance, and enables tracking of operator performance in addition to excavator performance.

Figure 20:
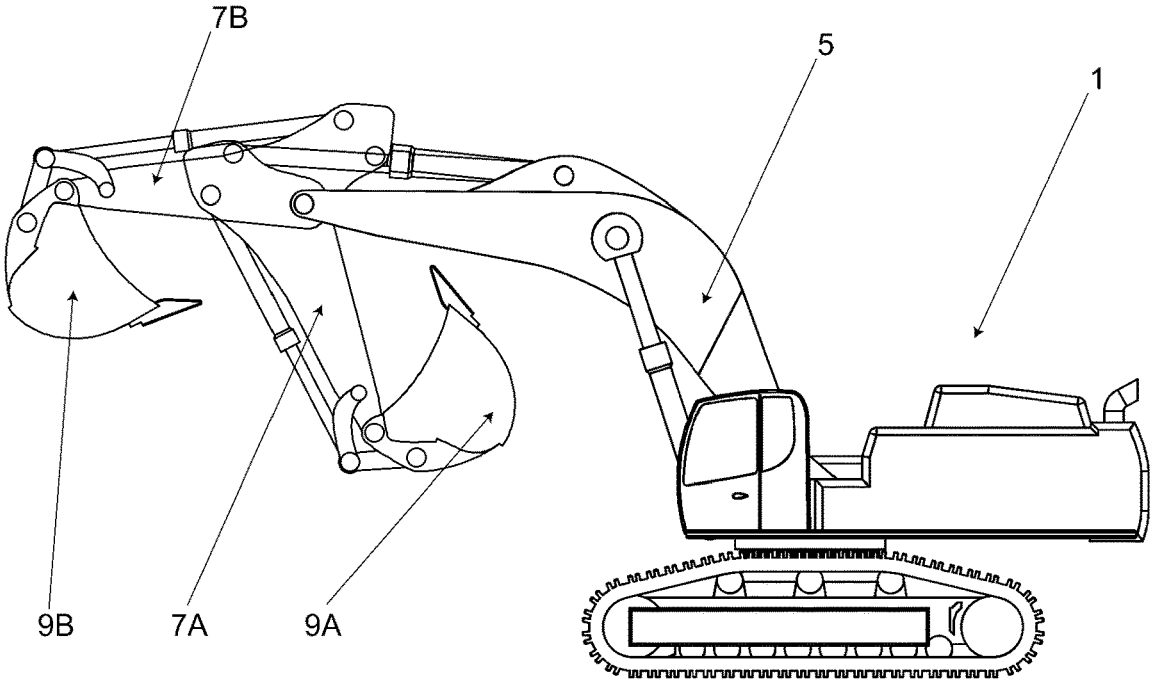
FIG. 20 shows another side view of the excavator shown in FIG. 1.

An example performance assessment procedure for the stick 7 of the excavator will now be described with reference to FIGS. 20-24. FIG. 20 shows a side view of the excavator in a typical starting and end position for performance assessment movements, showing the stick 7 in a lowered position (7*a*) and the raised position (7*b*).

An example procedure for the performance assessment of the stick 7 of the excavator 1 is as follows. Firstly, specific movements of the boom 7 of the excavator 1 are performed by an operator. The bucket 9 is curled in fully and at eye level of the operator. The stick 7 is then extended out from its starting position to an extended position to the full extent ('end of travel'—represented as 7*b* in FIG. 20). The stick 7 is returned in to the starting position to the full extent ('end of travel'—represented as 7*a* in FIG. 20).

Figure 21:
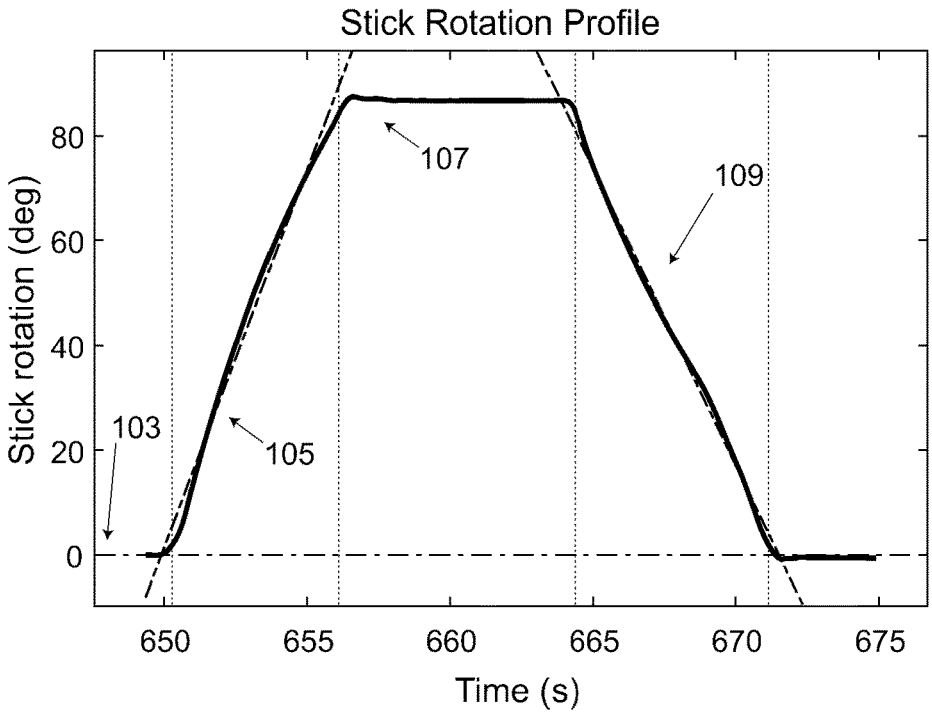
FIG. 21 shows the angular displacement of the stick according to an embodiment of the present disclosure.

The processor is configured to compile the plurality of third signals to produce a third graph that plots the plurality of third signals against time. The third graph may be in the form of several graphs that plot, or otherwise represent, each of the outputs of the third sensor unit against time. An example of the third graph is shown in FIG. 21, which shows the angular displacement of the stick 7 (relative angular displacement on the y-axis v time on the x-axis). The outputs of the third sensor unit may be similar to that described above for the first and second sensors. Similar to the output of the first and second sensors, the output of the third sensor includes a measurement referred to as 'GYRO_Y', which corresponds to the rotational velocity of the stick about the third axis $Y_2$ (see FIG. 7) of the third joint 21 (see FIG. 3).

In a similar manner (not shown) to that described above with respect to the first sensor, the processor is configured to determine a region of interest in the graph of the third sensor outputs that represents a rotational movement of the stick 7 about the third axis $Y_2$ of the third joint 19.

As shown in FIG. 21, the stick 7 moves through four positions that includes lowered and stationary (region 103), which corresponds with the position of the stick 7*a* shown in FIG. 20, 'stick out' (i.e. the stick rotating outwardly away from the cab to the position shown by stick 7*b* in FIG. 20—region 105), raised and stationary (region 107) and 'stick in' (i.e. the stick 7 rotating inwardly towards the cab to the position of the stick 7*b* shown in FIG. 20—region 109). The system is configured to determine and track the following key measurements for displacement of the stick, which are useful characteristics to assess stick performance:

- time taken to reach maximum rotational velocity for the stick being raised and lowered;
- maximum rotational velocity value for the stick being raised and lowered; and
- the rotational acceleration for the stick being raised and lowered.

Figure 22:
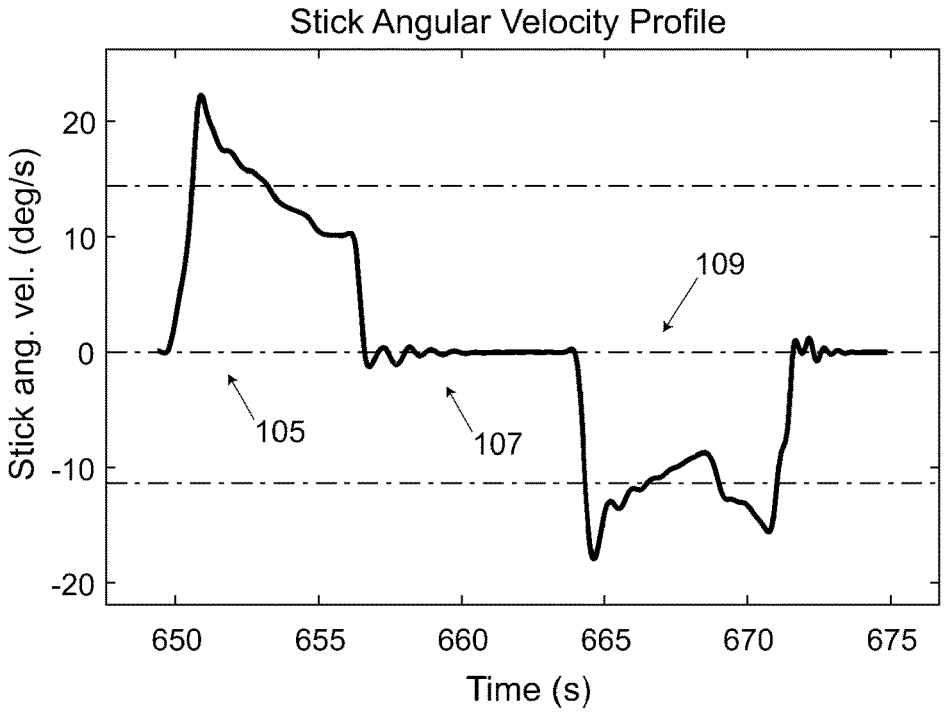
FIG. 22 provides a graph representing displacement of the stick shown in FIG. 21.

FIG. 22 provides another example of an output of the system for the assessment of displacement of the stick 7. FIG. 22 provides a typical graph of rotational velocity (degrees/second on the y-axis) v time (x-axis) for the stick assessment procedure. In a similar manner to that previously described for the first and second sensors, the system determines maximum rotational velocity for the stick and average constant maximum rotational velocity for the stick. The system is also configured to store the rotational velocity profile (as represented in FIG. 22) for comparison between excavators and for use as the excavator ages for performance assessment purposes. As can be seen in region 107 shown in FIG. 22 (corresponds with the position where the stick 7 is raised and stationary), the stick 7 oscillates about the third joint 17 (see FIG. 2) and is allowed to settle (i.e. the amplitude of oscillations decrease over time).

Assessing the kinematic performance of the stick 7 as it moves from a lowered to raised position is most useful for assessing the hydraulic component configured to rotate the stick about the third joint 19. As such, in the detailed embodiment, the system is configured to isolate the portion of the data that represents this movement (i.e. region 105 in FIGS. 19 and 20). This is shown in FIG. 23, which provides a typical graph of rotational velocity (degrees/second on the y-axis) v time (x-axis) for performance assessment procedure that corresponds with raising the stick.

Figure 23:
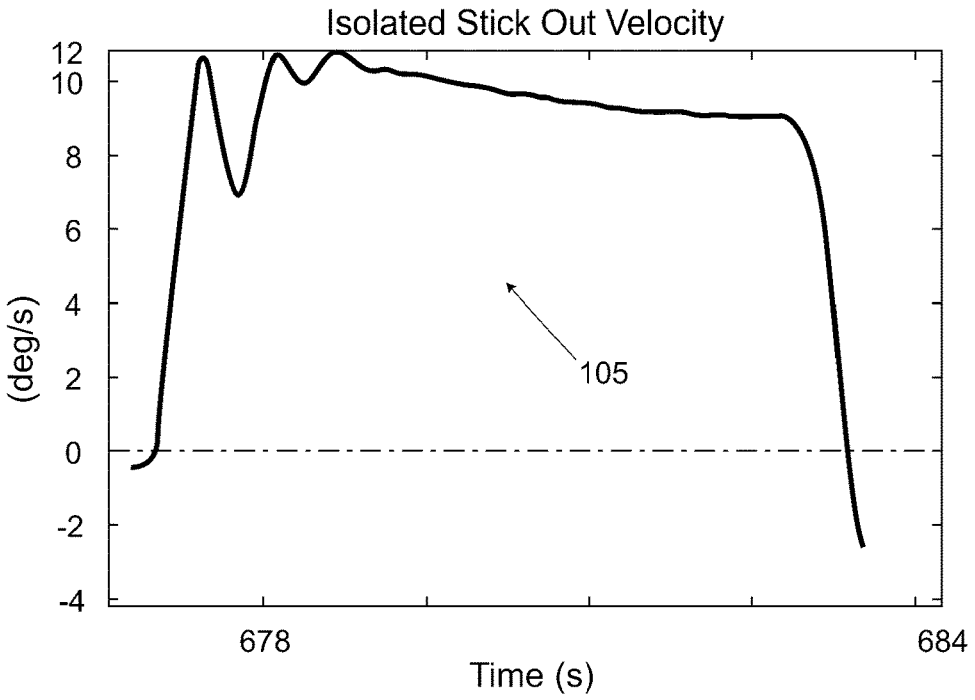
FIG. 23 provides a typical graph of rotational velocity of the stick shown in FIG. 22.
Figure 24:
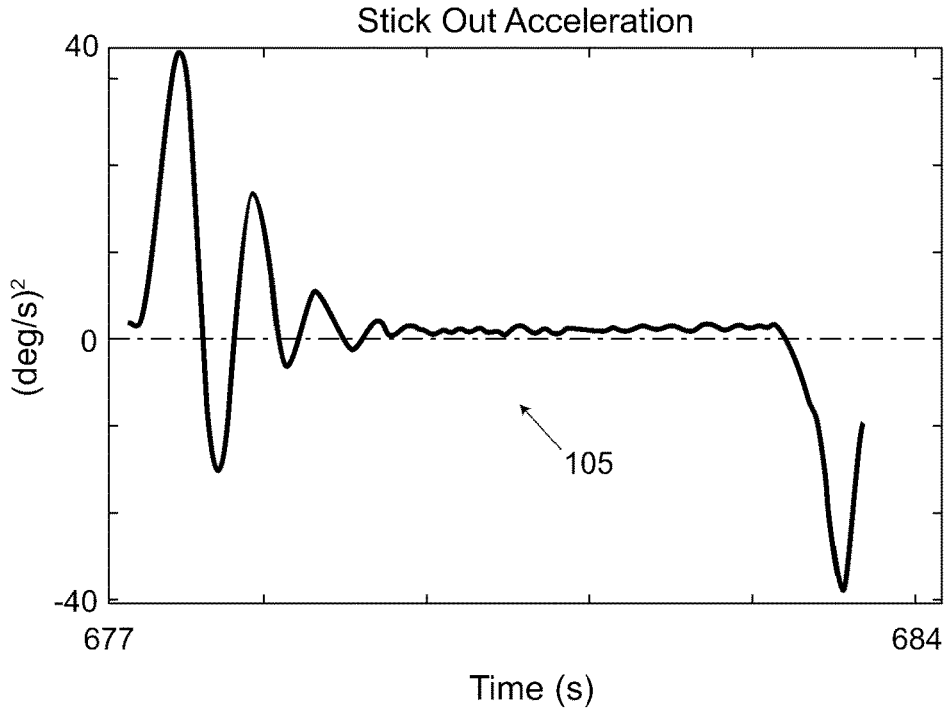
FIG. 24 shows a further graphical representation for the stick shown in FIG. 21.

Rotational acceleration for the stick is obtained by differentiation of the curve shown in FIG. 23 and yields the graph shown in FIG. 24. FIG. 24 shows degrees/second2 (y-axis) v time (x-axis) for the performance assessment procedure that corresponds with raising the stick. As can be seen in FIG. 24, the acceleration of the stick is not linear.

Similar to that described above with respect to the body and the boom, the Applicant has discovered that setting the pressure and flow of hydraulic components (such as the hydraulic component configured to enable rotation of the stick relative to the boom of the excavator) to specified values is not an optimum method for maintaining and commissioning a hydraulic excavator. This traditional method may not result in the optimal (e.g. as specified by a manufacturer) performance. The system disclosed herein advantageously enables the kinematic performance of the stick of a hydraulic excavator to be assessed dynamically. In the event that the kinematic performance is not optimal (e.g. not achieving the specified rotational velocity and acceleration), the operator (this may be via the equipment provider) is able to adjust the hydraulic component associated with the rotation of the stick (e.g. away from the settings specified by the manufacturer to achieve a specified performance). As such, the performance of the hydraulic excavator is able to be optimised (e.g. to move faster) using the system disclosed herein, which provides many benefits to the user of the excavator. Also, it enables the operator and the stick to be assessed independently of one another, which removes human error from the assessment of the performance of an excavator, enables operators to be further educated to increase performance, and enables tracking of operator performance in addition to excavator performance.

Figure 25A:
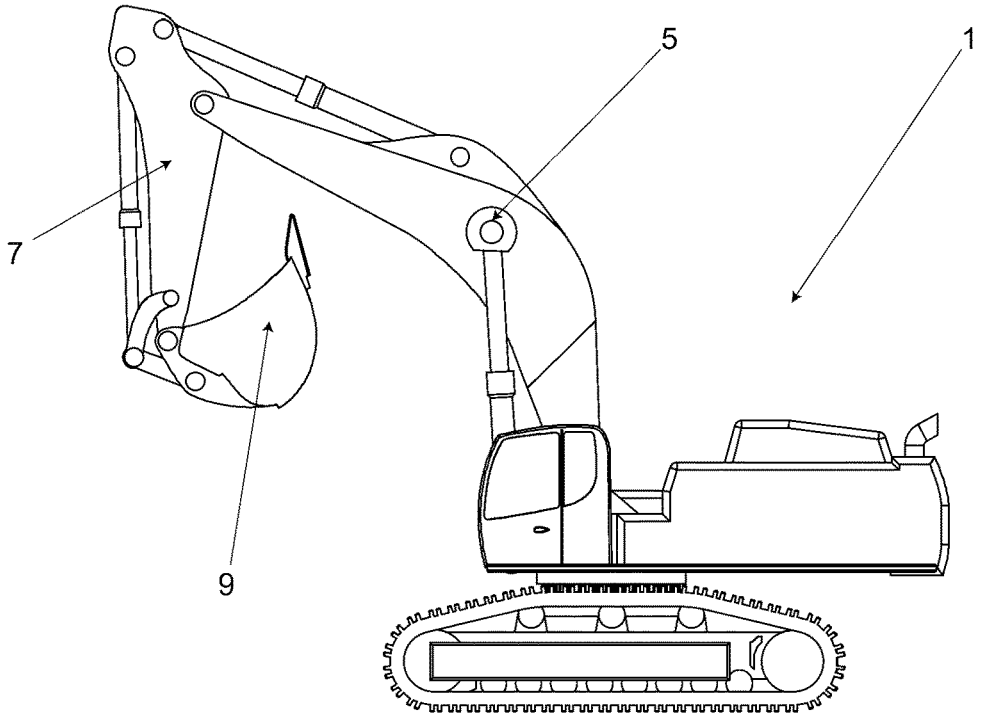
FIG. 25 shows further side views of the excavator shown in FIG. 1.

An example performance assessment procedure for the bucket 9 of the excavator will now be described with reference to FIGS. 25-28. FIG. 25*a* shows a side view of the excavator in a typical starting position for performance assessment movements, with the bucket 9 crowded (e.g. curled) in towards boom 5. FIG. 16*b* shows a side view of the excavator in a typical end position for performance assessment movements, with the bucket 9 crowded away from the boom 5.

An example procedure for the performance assessment of the bucket 9 of the excavator 1 is as follows. Specific movements of the bucket 9 of the excavator 1 are performed by an operator. The bucket 9 is curled in and out to the full extent of its travel in a repetitive (i.e. between the positions shown in FIG. 25*a-b*).

Figure 26:
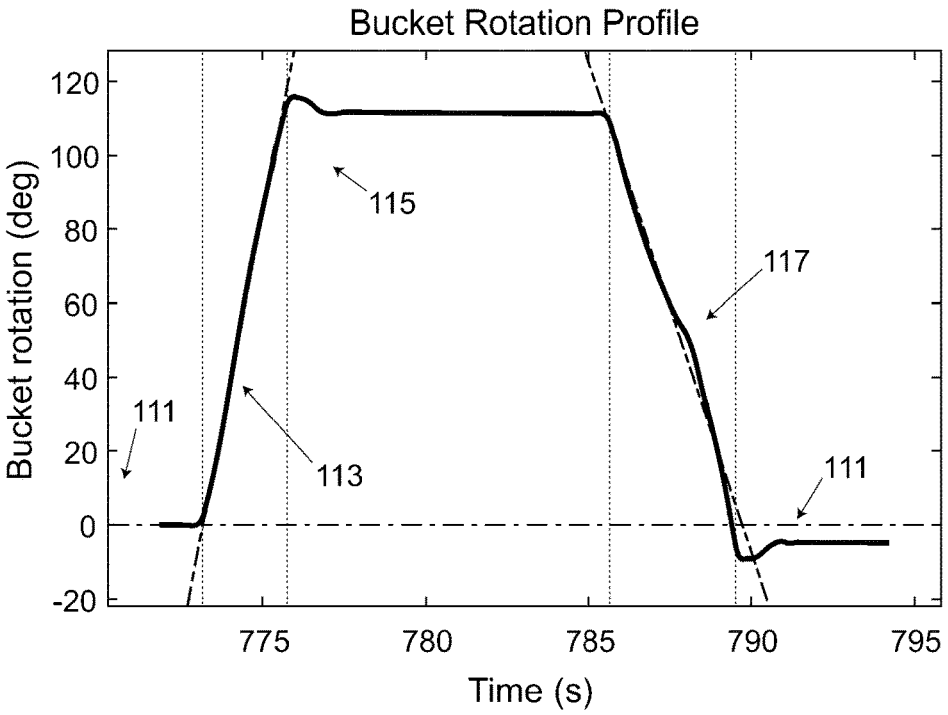
FIG. 26 provides a graph which shows the angular displacement of the bucket according to an embodiment of the present disclosure.

The processor is configured to compile the plurality of fourth signals to produce a fourth graph that plots the plurality of fourth signals against time. The fourth graph may be in the form of several graphs that plot, or otherwise represent, each of the outputs of the fourth sensor unit against time. An example of the fourth graph is shown in FIG. 26, which shows the angular displacement of the bucket 9 (relative angular displacement on the y-axis v time on the x-axis). The outputs of the fourth sensor unit may be similar to that described above for the first, second and third sensors. Similar to the output of the first, second and third sensors, the output of the fourth sensor includes a measurement referred to as 'GYRO_Y', which corresponds to the rotational velocity of the bucket about the fourth axis $Y_3$ (see FIG. 7) of the fourth joint 21 (see FIG. 3).

In a similar manner (not shown) to that described above with respect to the first sensor, the processor is configured to determine a region of interest in the graph of the fourth sensor outputs that represents a rotational movement of the bucket 9 about the fourth axis $Y_2$ of the fourth joint 21.

Figure 25B:
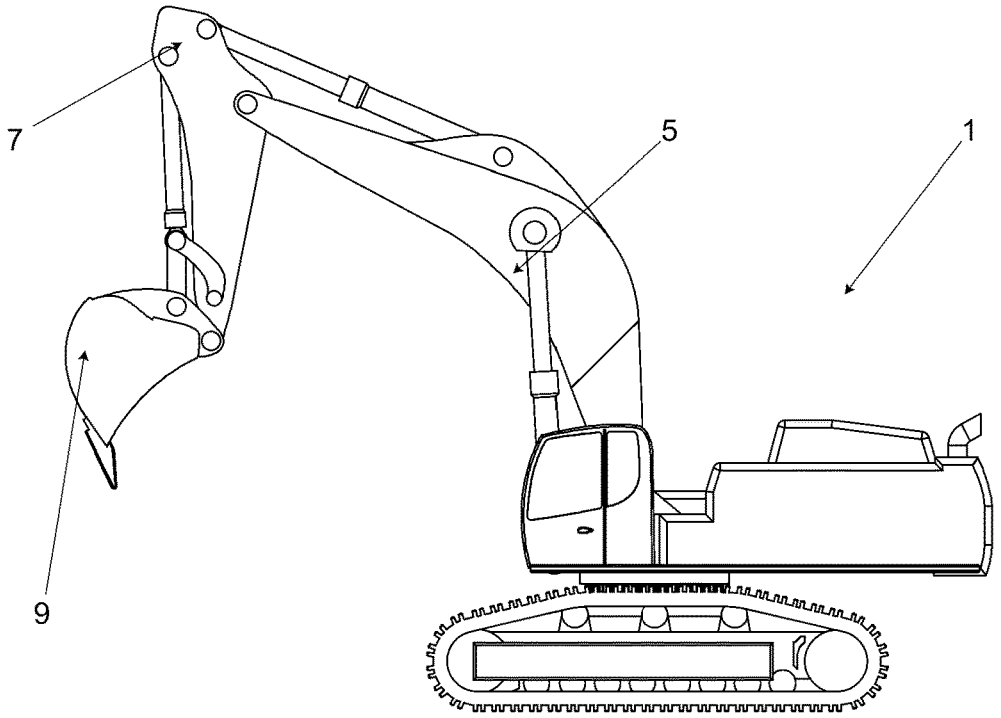

As shown in FIG. 26, the bucket 9 moves through four positions that includes 'curled in' and stationary (region 111), 'curling out' (i.e. the bucket rotating outwardly away from the cab to the position shown in FIG. 25*b*—region 113), curled out and stationary (region 115) and 'curling in' (i.e. the bucket 9 rotating inwardly towards the cab to the position shown in FIG. 25*a*—region 117). The system is configured to determine and track the following key measurements for displacement of the bucket, which are useful characteristics to assess stick performance:

- time taken to reach maximum rotational velocity for the bucket being curled in and out;
- maximum rotational velocity value for the bucket being curled in and out; and
- the rotational acceleration for the bucket being curled in and out.

Figure 27:
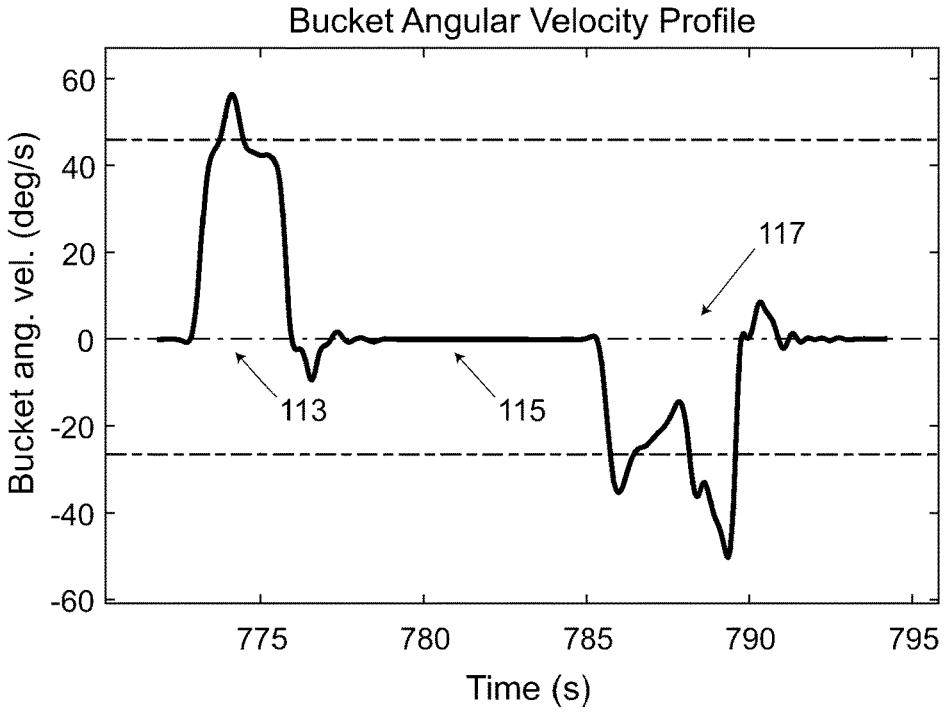
FIG. 27 provides another example of an output of the system for the assessment of displacement of the bucket shown in FIG. 26.
Figure 28:
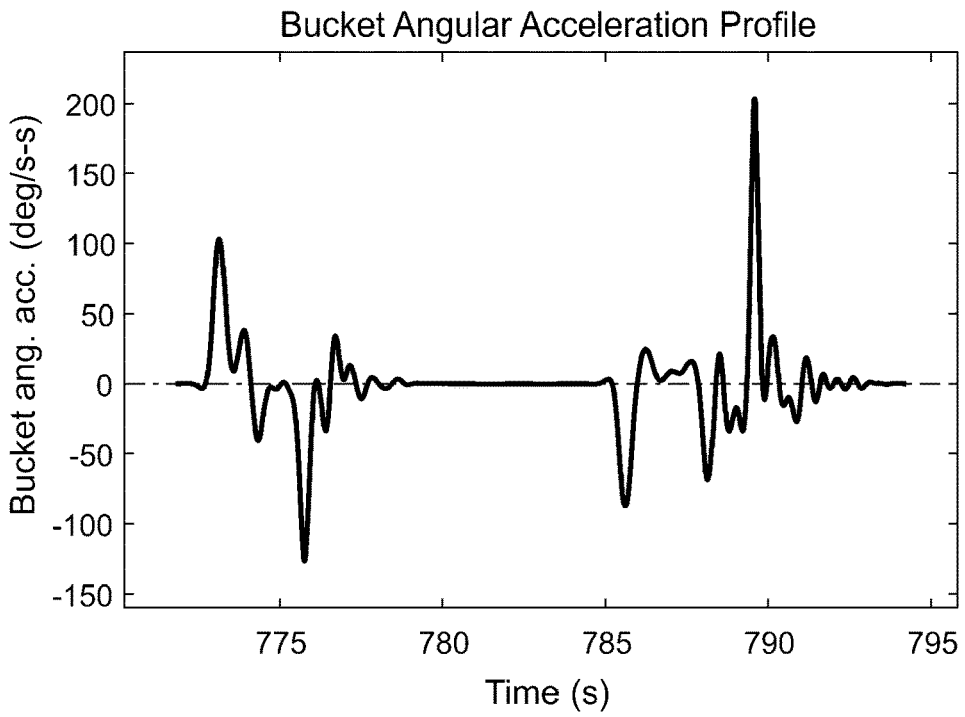
FIG. 28 provides a graph of the rotational acceleration for the bucket obtained by differentiation of the curve shown in FIG. 27.

FIG. 27 provides another example of an output of the system for the assessment of displacement of the bucket 9. FIG. 27 provides a typical graph of rotational velocity (degrees/second on the y-axis) v time (x-axis) for the bucket assessment procedure. Rotational acceleration for the bucket is obtained by differentiation of the curve shown in FIG. 27 and yields the graph shown in FIG. 28. FIG. 24 shows degrees/second2 (y-axis) v time (x-axis) for the performance assessment procedure that corresponds with moving the bucket. The most useful aspect of the data obtained in relation to the movement of the bucket for kinematic performance assessment purposes is the initial response of the bucket (i.e. start of rotation from the curled in and curled out positions) and the peak acceleration of the bucket.

Similar to that described above with respect to the body, boom and stick, the Applicant has discovered that setting the pressure and flow of hydraulic components (such as the hydraulic component configured to enable rotation of the bucket relative to the stick of the excavator) to specified values is not an optimum method for maintaining and commissioning a hydraulic excavator. This traditional method may not result in the optimal (e.g. as specified by a manufacturer) performance. The system disclosed herein advantageously enables the kinematic performance of the bucket of a hydraulic excavator to be assessed dynamically. In the event that the kinematic performance is not optimal (e.g. not achieving the specified rotational velocity and acceleration), the operator (this may be via the equipment provider) is able to adjust the hydraulic component associated with the rotation of the bucket (e.g. away from the settings specified by the manufacturer to achieve a specified performance). As such, the performance of the hydraulic excavator is able to be optimised (e.g. to move faster) using the system disclosed herein, which provides many benefits to the user of the excavator. Also, it enables the operator and the bucket to be assessed independently of one another, which removes human error from the assessment of the performance of an excavator, enables operators to be further educated to increase performance, and enables tracking of operator performance in addition to excavator performance.

Figure 29:
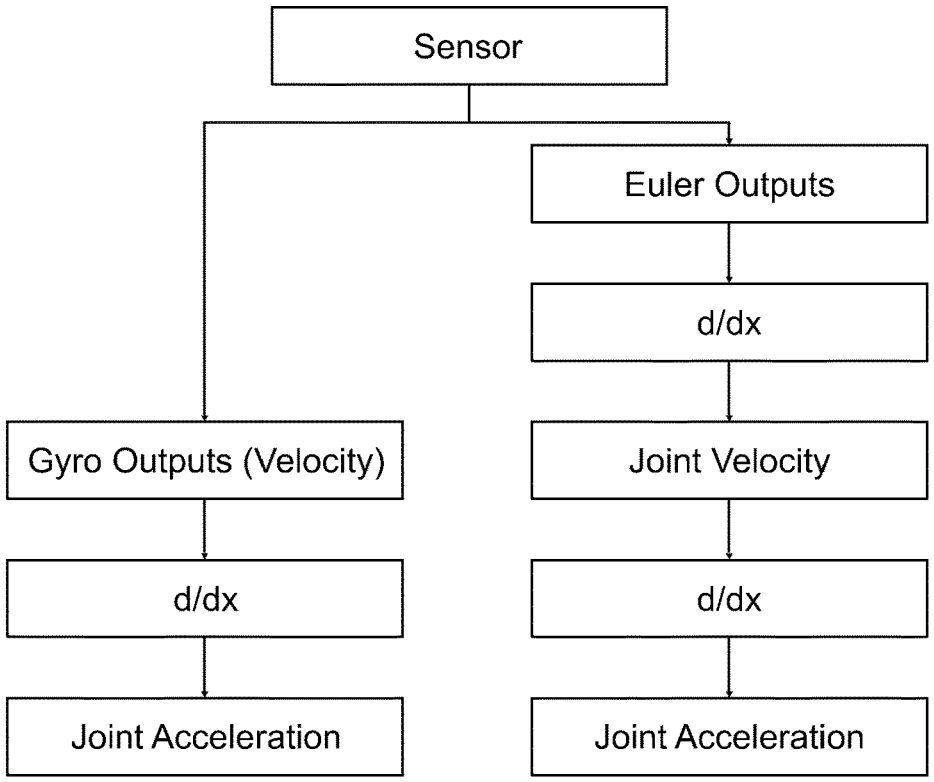
FIG. 29 provides an overview of contrasting methods used to determine kinematic performance characteristics according to an embodiment of the present disclosure.

As will be apparent to the skilled addressee, there are at least two options available for determining the key outputs used in the system to characterise kinematic performance (joint position, velocity and acceleration). In the detailed embodiments, the derivatives of the gyroscope outputs are utilized because the gyroscope outputs offer a direct output for velocity (native outputs for gyroscopes) and required only a single derivative to determine acceleration. The Euler output from the sensor, when implemented, is a function of the integration of the gyroscope outputs with the accelerometers and magnetometers in the sensor unit to determine position. FIG. 29 provides an overview of contrasting methods used to determine kinematic performance characteristics using Euler outputs in lieu of native gyroscope outputs. Using the Euler outputs to determine velocity through differentiation may produce inaccurate results as the result is filtered leading to potential misrepresentation of the system. There may be small differences between derived velocity and that outputted from the gyroscope itself (i.e. rather than deriving from the Euler angles). For all derivations of velocity and acceleration the gyroscope may be used as its native output is angular velocity. While the use of Euler angles in useful and enables an assessment of kinematic performance to be made, the Applicant has determined that Euler derived velocity underestimates the peaks of the measurement. This is likely due to heavy filtering that is required to smooth the data.

The detailed embodiment disclosed above includes one sensor for each joint. This is typical for a system that is permanently installed on the excavator. While one sensor could be placed on a joint, and moved as outlined above (isolating each joint), the ability to simultaneously assess the machine is forgone. Being able to assess each joint simultaneously has several advantages, as is discussed further below. Having said that, a single sensor can be used for performing an 'isolated movement' performance assessment (e.g. during non-productive digging to ensure the machine is operating as specified). A single sensor can be fitted to the bucket of the excavator (e.g. adjacent the bucket joint) and each movement performed as described above (i.e. movements of one or more of the bucket, boom, stick and body). If the bucket is kept stationary in respect to the other joints while the performance assessment movements are undertaken, it will directly measure the rotational velocity associated with the movement(s).

The use of four sensor units (i.e. a sensor unit associated with each hydraulic component) is useful as it enables a full kinematic model to be produced by the system for the excavator. This model can be used to visually represent machine movements to train operators and service the excavator (e.g. to adjust the hydraulic components to ensure that the excavator is operating as specified). Four sensors are used to calculate the relative positions (Angles) between each joint to support a full kinematic model which is used to calculate where each excavator component is in space. This can be used to calculate joint variables (velocity and acceleration) while the machine is performing digging for a comparison (e.g. while the machine is loaded) and evaluate how the operator is sequencing the digging operation (e.g. derived from a Jacobian matrix for the excavator). With orientation of each joint (e.g. as provided by the sensors Euler output), the excavator can be surveyed to determine the link lengths and a kinematic model is able to be produced by the system.

At present, new excavator commissioning and confirmation of performance is typically performed in field with a stop watch. This tells a mechanic/engineer the speed to complete a characteristic movement which is used to quantify performance. A typical commissioning sheet for an excavator assesses the time taken for the components of the excavator to complete a particular movement (e.g. similar to the assessment procedures discussed above). As such, present testing in the industry indicates that performance is measured as a given final time (time taken to travel between two points) with no regard to velocity nor acceleration. The Applicant has determined that this methodology doesn't provide the level of detail required to accurately characterise the performance of the system (i.e. to then allow for physical adjustments to be made to the excavator to increase excavator efficiency), nor can it be used to provide operator management and training. The system disclosed herein enables excavator operators to understanding the excavator non-linear velocity and acceleration with respect to time, which is paramount to ensuring optimal performance (e.g. by way of physical adjustments to hydraulic components to increase the efficiency of the excavator).

Real world excavator kinematics are subject to non-linear characteristics as a result of less than optimal operating conditions. There is a difference between approximating boom up function with a linear fit and assuming a constant acceleration with respect to time. For example, applying the first derivative of a linear fit for the velocity associated with raising the boom produces a constant velocity. However, in reality, the angular velocity of the boom oscillates (as previously discussed). Therefore, from a mathematical prospective, linearly fitting joint movements may result in a function that experiences no acceleration (e.g. the joint instantaneously accelerates). This, in reality, is impossible however both measurements serve a purpose. The linear fit can provide a single "effective measure" for high level comparison purposes, and the actual measured velocity (as discussed above) can indicate system transients; highlighting factors such as poor machine maintenance, faults, poor control systems, poor operator input, degrading seals and valves, etc. This is very useful, again for the purposes of optimising an excavator to ensure that it is operating efficiently (e.g. as specified by a manufacturer).

Analysis of the data obtained from sensors in the present disclosure may be performed manually in the case of the retrofit system used for one off machine commissioning. Permanent installations of the system are typically configured to use time series data extraction to extract and summarise the regions of interest (machine displacement, velocity and acceleration characteristics). Automatic extraction is performed to avoid tedious manual extraction of data which would prove impossible at scale; e.g. analysing a production machine which may load 200 trucks in a single 12 hours shift (800 different bucket loads). As will be evident to the skilled addressee, there is several well defined methods for data extraction which include: time series windowing, frequency domain extraction, edge detection, piecewise description, state machine implementation, implementation of rule based heretics with thresholds/weights, and machine learning. In the detailed embodiment, the system will implements time series windowing, brute force method. This provides two outputs: namely sensor data, and operator feedback and coaching. As discussed above, the identification of the machine inputs provide for the differentiation between operator and machine performance. In the detailed embodiment, system outputs, such as average slew angles by operator by shift, may be provided to the operator (e.g. an extension of present in-cab data provided to the operator).

It is convenient if all of the sensors mounted to the excavator are fitted to parallel planes. If one of the sensors axis' (typically Z) are aligned with that of the rotation of the joint, no transformation calculations are required to map a rotation of what the sensor is reading to that of the joints' axis of rotation as they are concentric. Technically, the sensors can be placed in any orientation on the joint and measure the same result using the Euler outputs and first and second derivatives (velocity and acceleration). The Euler outputs take into consideration the local geodetic frame (gravity, from the magnetometers or GPS if available).

In another embodiment, the sensor unit(s) disclosed herein may include an image capturing device (e.g. a camera) to assess objective performance (profile joint velocity and acceleration of a production excavator). For example, a fixed camera may record a production excavator with the travel brake applied (e.g. no movement of the excavator except for the joint being assessed). A joint may be moved from a fixed position relative to the camera and joint displacement is able to be estimated over time using the timestamp of the video footage recorded at, for example, sixty frames per second. Likewise, a camera may be placed on the body of the excavator with a view of the excavator component(s) for continuous monitoring. This may be used for estimation of parameters for all joints and also me serve to provide context if a sensor unit as disclosed above is fitted following the initial estimation.

Embodiments of the system disclosed herein is able to identify actual kinematic performance through direct measurement of movement as opposed to simply measuring the two primary performance parameters which are: hydraulic pump pressure and flow (value/solenoid opening). Usually these have a set value and a maintainer will just seek to set pressures according to a specification for a particular excavator. The Applicant has determined that this does not necessarily correlate to a given speed or acceleration. As such, the system disclosed herein allows operators to determine if a excavator is a 'slow machine'.

In at least one embodiment, the system disclosed herein is able to produce a comparison between excavators of the same make, model and configuration and age for relative comparison (e.g. compare each velocity, position and acceleration) to identify poor performance, malfunctions or issues (hydraulic pressure and flow). In at least one embodiment, the system disclosed herein enables operators to define performance by allowing for a comparison between machine models and makes in the same weight class for performance (providing base performance characteristics over what is available from vendors to allow better selection of equipment). In at least one embodiment, the system disclosed herein provides an improved and more accurate measurement than a stop watch to quantify machine performance. In at least one embodiment, the system disclosed herein allows technicians to better identify what maintenance or tuning is required, allows vendors to improve on their commissioning processes for new machines and allows vendors to clearly demonstrate compliance with real-world performance metrics. In at least one embodiment, the system disclosed herein allows for an assessment of maintenance procedures (e.g. maintainers can use the system to hit a specific maximum speed and profile rather than just tuning to a specific pressure with no feedback on how this pressure is effecting the system other than the arbitrary 'feelings' of an operator. In at least one embodiment, the system disclosed herein allows for an assessment to differentiate between operator and machine performance (e.g. machine performance is able to be isolated for operator performance).

The system disclosed herein may extend its functionality by using sensor information to provide analysis of an operator's performance based upon comparing operator inputs with industry best practices. Such practices may include: average slewing angle for loading operations (e.g. a determination of whether the operator is slewing too far and thereby reducing productivity), dig sequence (e.g. a determination of whether the operator is following the correct dig sequence, engaging the dirt that has been blasted in a correct location, sequencing to maximize productivity, engagement height on face, etc.), average bucket angle of engagement to digging face (e.g. determining a maximum breakout force on material, which may influence a bucket fill factor). Such determinations may be performed by comparing the position of an excavator component (e.g. the bucket), which may be kinematically calculated using the sensor system disclosed herein. Identification of non-compliance to best practices by the system may then be flagged for review using, for example, the video cameras and used as a training aid for operators.

One such example can be determining excessive slewing angle which should be ideally between 45 and 90 degrees (truck loading to dig face). Rotation position is determined kinematically, using a sliding window to determine state, an initial increase in rotational velocity followed by a decrease threshold value indicates the excavator is most likely undertaking productive loading. Once the state has been determined, angular position is noted and recorded.

Figure 30:
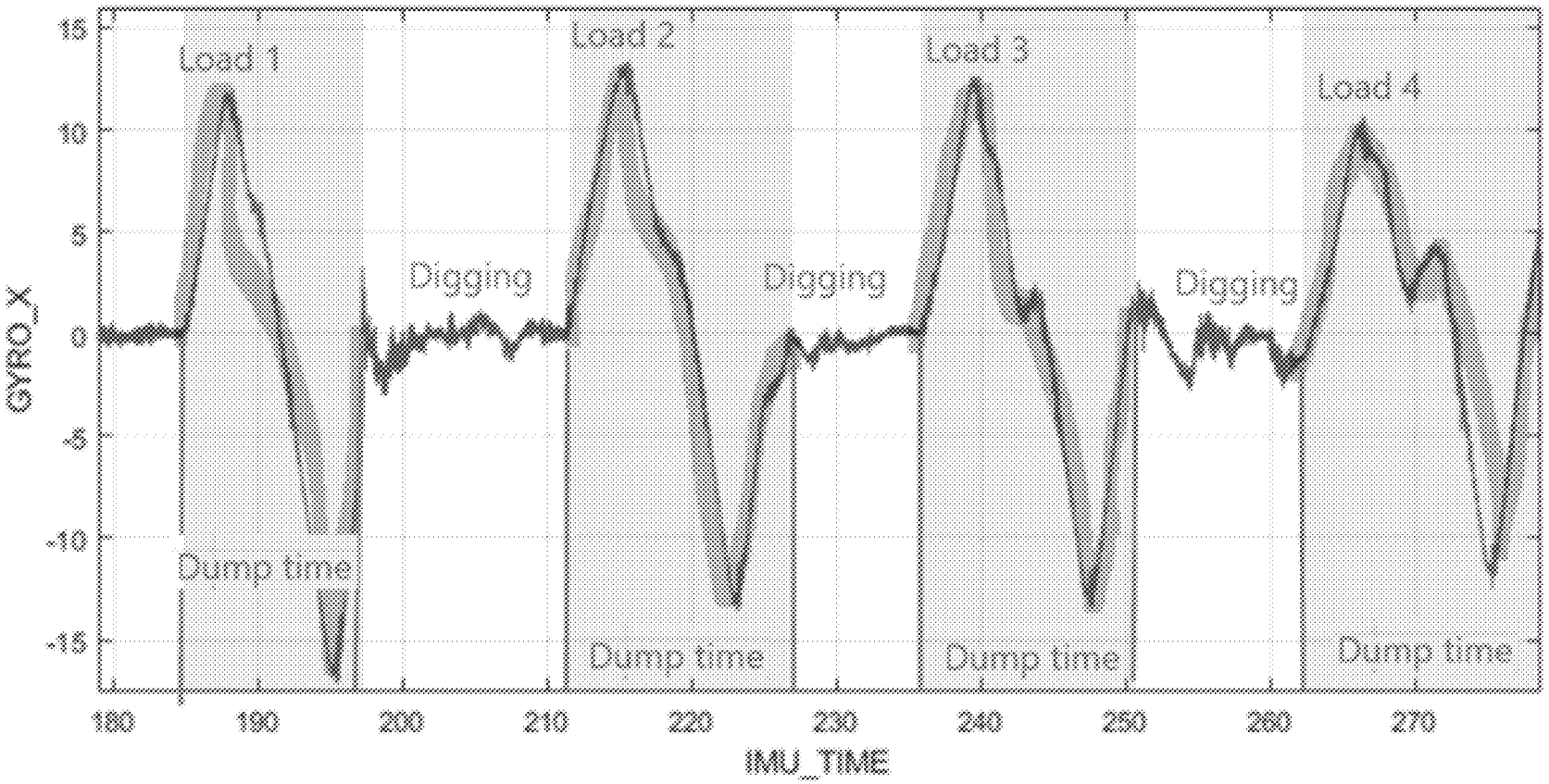
FIG. 30 provides a graph in which a loading sequence is identified by observing slewing (yaw) velocity.

In the graph shown in FIG. 30, a loading sequence is identified by observing slewing (yaw) velocity. The curve can be differentiated, or timestamp matched with the Euler output of the system to determine the slewing angle between each load and averaged for each operator. This is only one such example and, as will be evident to the skilled addressee, the core of the solution is knowing how the machines move in space by derivation of the kinematic model.

The word 'comprising' and forms of the word 'comprising' as used in this description and in the claims does not limit the invention claimed to exclude any variants or additions.

Modifications and improvements to the invention will be readily apparent to those skilled in the art. Such modifications and improvements are intended to be within the scope of this invention.

The invention claimed is:

1. A system for tuning hydraulic components of a production digger, the production digger comprising an undercarriage configured to move the production digger, a body rotatably connected to the undercarriage about a first joint, a boom rotatably connected to the body about a second joint, a stick rotatably connected to the boom about a third joint, a bucket rotatably connected to the stick about a fourth joint, a first hydraulic component connected to the undercarriage and body that is configured to enable the body to rotate relative to the undercarriage, a second hydraulic component connected to the boom and the body that is configured to enable the boom to rotate relative to the body, a third hydraulic component connected to the boom and the stick that is configured to enable the stick to rotate relative to the boom, a fourth hydraulic component connected to the bucket and the stick that is configured to enable the bucket to rotate relative to the stick; the system comprising;

a first sensor unit mounted to the body of the production digger, the first sensor unit being configured to output a plurality of first signals indicative of a rotational velocity of the body about the first joint and a rotational acceleration of the body about the first joint;

a second sensor unit mounted to the boom of the production digger, the second sensor unit being configured to output a plurality of second signals indicative of a rotational velocity of the boom about the second joint and a rotational acceleration of the boom about the second joint;

a third sensor unit mounted to the stick of the production digger, the third sensor unit being configured to output a plurality of third signals indicative of a rotational velocity of the stick about the third joint and a rotational acceleration of the stick about the third joint;

a fourth sensor unit mounted to the bucket of the production digger, the fourth sensor unit being configured to output a plurality of fourth signals indicative of a rotational velocity of the bucket about the fourth joint and a rotational acceleration of the bucket about the fourth joint;

a processor in communication with the first, second, third and fourth sensor units, the processor being configured to:

receive the plurality of first, second, third and fourth signals;

determine the rotational velocity of the body about the first joint, and rotational acceleration of the body about the first joint in dependence on the plurality of first signals;

determine the rotational velocity of the boom about the second joint, and the rotational acceleration of the boom about the second joint in dependence on the plurality second signals;

determine the rotational velocity of the stick about the third joint, and the rotational acceleration of the stick about the third joint in dependence on the plurality third signals;

determine the rotational velocity of the bucket about the fourth joint, and the rotational acceleration of the bucket about the fourth joint in dependence on the plurality fourth signals;

and a display in communication with the processor, the display being configured to:

display tuning information to a user, the tuning information comprising the rotational velocity and rotational acceleration of the boom, stick, body and bucket determined by the processor, wherein the user is able to tune the first, second, third and fourth hydraulic components of the production digger in dependence on the tuning information wherein the processor is configured to compile:

the plurality of first signals to produce a first graph that plots the plurality of first signals against time;

the plurality of second signals to produce a second graph that plots the plurality of second signals against time;

the plurality of third signals to produce a third graph that plots the plurality of third signals against time; and the plurality of fourth signals to produce a fourth graph that plots the plurality of fourth signals against time;

and wherein the processor is configured to determine:

a first region of interest in the first graph that represents a rotational movement of the body, and the rotational velocity and rotational acceleration of the body in the first region of interest;

a second region of interest in the second graph that represents a rotational movement of the boom, and the rotational velocity and rotational acceleration of the boom in the second region of interest;

a third region of interest in the third graph that represents a rotational movement of the stick, the rotational velocity and rotational acceleration of the stick in the third region of interest; and a fourth region of interest in the fourth graph that represents a rotational movement of the bucket, and the rotational velocity and rotational acceleration of the bucket in the fourth region of interest.

2. A system according to claim 1, wherein:

the plurality of first signals is indicative of a relative position of the body, the plurality of second signals is indicative of a relative position of the boom, the plurality of third signals is indicative of a relative position of the stick, and the plurality of fourth signals is indicative of a relative position of the bucket.

3. A system according to claim 2, wherein the processor is configured to:

determine the relative position of the body in dependence on the plurality of first signals, determine the relative position of the boom in dependence on the plurality of second signals, determine the relative position of the stick in dependence on the plurality of third signals, and determine the relative position of the bucket in dependence on the plurality of fourth signals, and the tuning information comprises the relative position of the body, bucket, stick and bucket determined by the processor.

4. A system according to claim 3, wherein:

the first sensor unit comprises a first gyroscope that is arranged to measure the angular velocity of the body about a first axis of the first joint, and wherein the plurality first signals is indicative of the angular velocity of the body about the first axis;

the second sensor unit comprises a second gyroscope that is arranged to measure the angular velocity of the boom about a second axis, and wherein the plurality of second signals is indicative of the angular velocity of the boom about second axis;

the third sensor unit comprises a third gyroscope that is arranged to measure the angular velocity of the stick about a third axis, and wherein the plurality of third signals is indicative of the angular velocity of the stick about the third axis; and the fourth sensor unit comprises a fourth gyroscope that is arranged to measure the angular velocity of the bucket about a fourth axis, and wherein the plurality of fourth signals is indicative of the angular velocity of the bucket about the fourth axis.

5. A system according to claim 4, wherein the first sensor unit comprises a magnetometer, an accelerometer and/or a GPS, the second sensor unit comprises a magnetometer, an accelerometer and/or a GPS; the third sensor unit comprises a magnetometer, an accelerometer and/or a GPS; and the fourth sensor unit comprises a magnetometer, an accelerometer and/or a GPS.

6. A system according to claim 5, wherein:

the first sensor unit is arranged to measure the angular acceleration of the body about the first axis, and wherein the plurality of first signals comprises the angular acceleration of the body about the first axis;

the second sensor unit is arranged to measure the angular acceleration of the boom about the second axis, and wherein the plurality of second signal comprises the angular acceleration of the boom about the second axis;

the third sensor unit is arranged to measure the angular acceleration of the stick about the third axis, and wherein the plurality of third signal comprises the angular acceleration of the stick about the third axis; and the fourth sensor unit is arranged to measure the angular acceleration of the stick about the fourth axis, and wherein the plurality of fourth signals comprises the angular acceleration of the stick about the fourth axis.

7. A system according to claim 6, wherein the first, second, third and fourth sensor units are each configured to output the plurality of first signals at between 1 Hz and 1 kHz, and wherein each of the plurality of first, second, third and fourth signals each comprises a timestamp.

8. A system according to claim 7, wherein:

the first sensor unit is configured to determine first and second Euler angles of the first sensor, and wherein the plurality of first signals outputted by the first sensor unit comprises the determined first and second Euler angles;

the second sensor is configured to determine third and fourth Euler angles of the second sensor, and wherein the plurality of second signal comprises the determined third and fourth Euler angles;

the third sensor is configured to determine fifth and sixth Euler angles of the third sensor, and wherein the plurality of third signals comprises the determined fifth and sixth Euler angles; and the fourth sensor is configured to determine seventh and eighth Euler angles of the fourth sensor, and wherein the plurality of fourth signals comprises the determined seventh and eighth Euler angles.

9. A system according to claim 1, wherein the display is configured to display the rotational velocity and rotational acceleration of the body in the first region of interest, the rotational velocity and rotational acceleration of the boom in the second region of interest, the rotational velocity and rotational acceleration of the stick in the third region of interest, and the rotational velocity and rotational acceleration of the bucket in the fourth region of interest.

10. A system according to claim 4, wherein the first axis is a first axis of rotation of the first sensor unit, and wherein the processor is configured to determine whether the first sensor unit is mounted to the body such that an orientation of the first sensor unit is aligned with the first axis of rotation of the first sensor unit, and to apply a transformation matrix to the orientation of the first sensor unit when the orientation of the first sensor unit is not aligned with the first axis of rotation of the first sensor unit.

11. A system according to claim 4, wherein the second axis is a second axis of rotation of the second sensor unit, and wherein the processor is configured to determine whether the second sensor unit is mounted to the boom such that an orientation of the second sensor unit is aligned with the second axis of rotation of the second sensor unit, and to apply a transformation matrix to the orientation of the second sensor unit when the orientation of the second sensor unit is not aligned with the second axis of rotation of the second sensor unit.

12. A system according to claim 4, wherein the third axis is a third axis of rotation of the third sensor unit, and wherein the processor is configured to determine whether the third sensor unit is mounted to the stick such that an orientation of the third sensor unit is aligned with the third axis of rotation of the third sensor unit, and to apply a transformation matrix to the orientation of the third sensor unit when the orientation of the third sensor unit is not aligned with the third axis of rotation of the third sensor unit.

13. A system according to claim 4, wherein the fourth axis is a fourth axis of rotation of the fourth sensor unit, and wherein the processor is configured to determine whether the fourth sensor unit is mounted to the bucket such that an orientation of the fourth sensor unit is aligned with the fourth axis of rotation of the fourth sensor unit, and to apply a transformation matrix to the orientation of the fourth sensor unit when the orientation of the fourth sensor unit is not aligned with the fourth axis of rotation of the fourth sensor unit.

14. A system according to claim 1, wherein the processor is configured to determine:

the rotational acceleration of the body using rotational velocity of the body;

the rotational acceleration of the boom using rotational velocity of the boom;

the rotational acceleration of the stick using rotational velocity of the stick; and the rotational acceleration of the bucket using rotational velocity of the bucket.

15. A system according to claim 8, wherein the plurality of first signals include a GPS location of the body, and wherein the processor is configured to use:

the first and second Euler angles to produce a first kinematic model of the body;

the third and fourth Euler angles to produce a second kinematic model of the boom;

the fifth and sixth Euler angles to produce a third kinematic model of the stick;

the seventh and eighth Euler angles to produce a fourth kinematic model of the bucket; and combine the first, second, third and fourth kinematic models to produce a kinematic model of the production digger.

16. A system according to claim 15, wherein the display is configured to display the kinematic model of the production digger.

17. A method of tuning hydraulic components of a production digger, the production digger comprising an undercarriage configured to move the production digger, a body rotatably connected to the undercarriage about a first joint, a boom rotatably connected to the body about a second joint, a stick rotatably connected to the boom about a third joint, a bucket rotatably connected to the stick about a fourth joint, a first hydraulic component connected to the undercarriage and body that is configured to enable the body to rotate relative to the undercarriage, a second hydraulic component connected to the boom and the body that is configured to enable the boom to rotate relative to the body, a third hydraulic component connected to the boom and the stick that is configured to enable the stick to rotate relative to the boom, a fourth hydraulic component connected to the bucket and the stick that is configured to enable the bucket to rotate relative to the stick; the method comprising;

mounting a first sensor unit to the body of the production digger, the first sensor unit being configured to output a plurality of first signals indicative of a rotational velocity of the body about the first joint and a rotational acceleration of the body about the first joint;

mounting a second sensor unit to the boom of the production digger, the second sensor unit being configured to output a plurality of second signals indicative of a rotational velocity of the boom about the second joint and a rotational acceleration of the boom about the second joint;

mounting a third sensor unit to the stick of the production digger, the third sensor unit being configured to output a plurality of third signals indicative of a rotational velocity of the stick about the third joint and a rotational acceleration of the stick about the third joint;

mounting a fourth sensor unit to the bucket of the production digger, the fourth sensor unit being configured to output a plurality of fourth signals indicative of a rotational velocity of the bucket about the fourth joint and a rotational acceleration of the bucket about the fourth joint;

receiving at a computer processor the plurality of first, second, third and fourth signals;

determining the rotational velocity of the body about the first joint, and rotational acceleration of the body about the first joint in dependence on the plurality of first signals using the computer processor;

determining the rotational velocity of the boom about the second joint, and the rotational acceleration of the boom about the second joint in dependence on the plurality second signals using the computer processor;

determining the rotational velocity of the stick about the third joint, and the rotational acceleration of the stick about the third joint in dependence on the plurality third signals using the computer processor;

determining the rotational velocity of the bucket about the fourth joint, and the rotational acceleration of the bucket about the fourth joint in dependence on the plurality fourth signals using the computer processor;

displaying on a display tuning information to a user, the tuning information comprising the rotational velocity and rotational acceleration of the boom, stick, body and bucket determined by the processor; and tuning the first, second, third and fourth hydraulic components of the production digger in dependence on the tuning information, wherein the method further comprises:

compiling the plurality of first signals using the computer processor to produce a first graph that plots the plurality of first signals against time;

compiling the plurality of second signals using the computer processor to produce a second graph that plots the plurality of second signals against time;

compiling the plurality of third signals using the computer processor to produce a third graph that plots the plurality of third signals against time;

compiling the plurality of fourth signals using the computer processor to produce a fourth graph that plots the plurality of fourth signals against time;

determining a first region of interest in the first graph that represents a rotational movement of the body, and the rotational velocity and rotational acceleration of the body in the first region of interest;

determining a second region of interest in the second graph that represents a rotational movement of the boom, and the rotational velocity and rotational acceleration of the boom in the second region of interest;

determining a third region of interest in the third graph that represents a rotational movement of the stick, the rotational velocity and rotational acceleration of the stick in the third region of interest; and determining a fourth region of interest in the fourth graph that represents a rotational movement of the bucket, and the rotational velocity and rotational acceleration of the bucket in the fourth region of interest.

* * * * *